US005653671A

United States Patent [19]

Reuteler

[11] Patent Number: 5,653,671

[45] Date of Patent: Aug. 5, 1997

[54] CARTON FEEDER ASSEMBLY

[75] Inventor: Urs Reuteler, Kennesaw, Ga.

[73] Assignee: Riverwood International Corporation, Atlanta, Ga.

[21] Appl. No.: 367,459

[22] Filed: Dec. 30, 1994

[51] Int. Cl.[6] ..... B31B 1/76; B31B 1/80

[52] U.S. Cl. ..... 493/313; 271/3.12; 271/95; 271/150; 493/315; 53/564; 53/381.1

[58] Field of Search ..... 271/3.01, 3.12, 271/11, 91, 95, 150, 157; 493/310, 312, 313, 315, 316, 317, 12, 29; 53/564, 565, 566, 381.1

[56] References Cited

U.S. PATENT DOCUMENTS

| | | | |
|---|---|---|---|
| 2,936,681 | 5/1960 | Earp . | |
| 3,293,998 | 12/1966 | Farnow . | |
| 3,728,945 | 4/1973 | Vuilleumier . | |
| 4,596,544 | 6/1986 | Hull | 493/313 |
| 4,596,545 | 6/1986 | Greenwell | 493/315 |
| 5,029,834 | 7/1991 | Boldrini | 271/11 |
| 5,104,369 | 4/1992 | Calvert | 493/315 |
| 5,279,095 | 1/1994 | Muller | 53/386.1 |
| 5,415,615 | 5/1995 | Culpepper | 493/315 |

*Primary Examiner*—Jack W. Lavinder
*Attorney, Agent, or Firm*—Isaf, Vaughan & Kerr

[57] ABSTRACT

A carton feeder assembly is positioned substantially at the infeed conveyor level and includes a carton supply assembly, a carton selector, a carton opener, and a carton erector. The carton supply assembly has a carton supply position, a carton holding position, and a carton selecting position. The carton selector includes a pair of feeder wheels with corresponding suction devices and respective motion defining assemblies. The motion defining assemblies cause the suction devices to move along a linear pick line as the feeder wheels rotate, so that the suction devices can apply a suction on a carton to be selected. The selected carton is brought into contact with the feeder wheels by retraction of the suction devices caused by respective motion defining assemblies, so that the carton moves with the feeder wheels to the carton opener. The carton opener includes a vacuum belt which applies suction to one surface of the selected carton as a carton opening wheel applies a suction to a second side of the selected carton. As the vacuum belt moves the carton in a linear direction, the carton opening wheel rotates the second side of the carton so that the carton opens. The vacuum belt then feeds the opened carton into leading lugs on respective chains of the carton erector. Trailing lugs rotate into position behind the opened carton to hold the carton in an erect position suitable for loading the carton with articles such as bottles or cans.

39 Claims, 12 Drawing Sheets

CARTON FEEDER ASSEMBLY

BACKGROUND OF THE INVENTION

1. Field of the Invention

This invention is directed to a carton feeder assembly including supply assembly, selector, opener and erector apparatuses, a system including these apparatuses, and methods for supplying, selecting, opening, and erecting collapsed paperboard cartons and other substantially planar workpieces.

2. Description of the Related Art

Various packaging operations are designed to package goods, for example, consumer items such as beverage and food containers, into paperboard cartons for shipment. Such packaging operations are well known, and include some mechanism for supplying the empty cartons to a packaging area, where the containers are placed into the cartons. These prior devices typically include mechanisms for erecting the collapsed carton, and for placing the carton onto a conveyor.

A prior system known as an overhead rotary feeder is mounted above the conveyor of a container grouping apparatus. The overhead-type carton feeder includes a central drive shaft with a pair of opposing mounting plates attached to the shaft at its respective ends. Toward the periphery of the plates, four vacuum shafts are rotatably mounted each having tubes extending perpendicularly therefrom. The tubes include suction cups at their ends. As the drive shaft of the overhead feeder rotates in, for example, a clockwise direction, the vacuum shafts rotate in the counterclockwise direction so that a pair of suction cups for a shaft momentarily faces a folded or collapsed carton in an overhead magazine. The suction cups releasably attach to the face of the folded carton and rotate downwardly toward the conveyor so that centrifugal force and gravity cause the folded carton to open. As the vacuum shaft further rotates, the opened carton is placed between lugs on the conveyer, which complete erection of the carton and move the carton to the next process step of the packaging operation.

Although meritorious in many respects, the above-described system suffers from significant drawbacks. The carton magazine also must be located over the conveyor, thereby requiring the operator to climb above the conveyor to load the carton supply magazine. The overhead feeder also decreases the operator's visibility of other machine elements and processes. Also, the speed of operation of the above-described system is limited, especially for large cartons, because at relatively high speeds of operation the force of air against the carton can be large enough to overcome the suction applied by the suction cups. This results in the cartons being released before placement between lugs on the conveyer, causing interruption of the entire process. Further, other inefficiencies and drawbacks are associated with such an overhead carton feeder system, which must releasably hold the carton during the counter-rotating carton erection and placement step. Therefore, there is a need for a system that will overcome the disadvantages noted above.

SUMMARY OF THE INVENTION

Briefly described, in a preferred form the present invention comprises a carton feeder assembly including a carton supply magazine or carton supply assembly, carton selector, carton opener, and carton erector. The carton supply assembly includes a conveyer disposed substantially at the container conveyor level, so that an operator can readily stack cartons onto the carton supply conveyer. The carton supply conveyer supports the bottom edges of folded cartons, and a top roller supports the top side portions of the cartons. The top roller and the conveyer define a carton supply position. At the forward end of the carton supply conveyer, a chute is arranged to receive the bottom edges of cartons advanced past the edge of the carton supply conveyer. The top edges of the cartons are supported by a finger or tab in a carton holding position. As cartons are picked from a carton selecting position defined by rollers and the chute, the bottom edge of the cartons move sufficiently downward in the chute so that the cartons in the carton supply position slide past the edge of the tab and thus fall to the carton selecting position. These features allow for the number of cartons in the carton selecting position to be maintained relatively constant, ensuring that the weight of the cartons in the carton selecting position is predetermined and sufficient to allow the carton selector or picker to apply suction on the first carton in the carton selecting position, but not so much weight as to prevent the carton selector from failing to slide the selected carton out of the carton selecting position.

The carton selector includes at least one feeder wheel with at least one gripping device, such as a suction device, for each stroke encompassed per rotation of the feeder wheel. The feeder wheel rotates under torque applied by an electric motor. The gripping or suction device is coupled to the feeder wheel by a motion defining assembly that defines the motion of the suction device. More specifically, the motion defining assembly causes the suction device to ride at or inside of the circumferential edge of the feeder wheel until the suction device rotates to a selection or pick line. The pick line is radial to the feeder wheel, and ideally is approximately perpendicular to the surface of a carton to be selected from the carton selecting or picking position. As the feeder wheel continues to rotate, the motion defining assembly causes the suction device to rotate in a direction opposite to the direction of rotation of the feeder wheel, so that the suction device is positioned on the pick line. The motion defining assembly also causes the suction device to advance along the pick line outward past the circumferential edge of the feeder wheel. The suction device is advanced by the motion defining assembly sufficiently far to make contact with the front surface of the carton which is in the carton selecting position. At this point, a vacuum or suction is applied to the front carton surface. The suction device is then retracted by the motion defining assembly radially inward on the picking line toward the circumferential edge of the feeder wheel until the selected carton clears the end of the carton top holder, and is retracted to engage with a feeder wheel. The rotation of the suction device in the direction opposite to the feeder wheel is then ceased, so that the selected carton rotates around and moves with the circumferential edge of the feeder wheel under force of friction applied by the suction device and/or a rubber covering of the feeder wheel. To ensure proper feeding, the selected carton is held against the feeder wheel by a nip roller.

In one embodiment of the motion defining assembly, a first shaft is coupled to a gear segment with teeth meshing with the teeth of a sun gear. A servomotor is coupled to the sun gear to rotate the sun gear and to cause the suction device to move in a selecting or picking motion in the manner previously described. In a second embodiment of the motion defining assembly, a cam follower lever has a first end coupled to the shaft, and a second end with a cam follower roll. The cam follower roll rides in a cam track of a cam mounted to the machine frame. Accordingly, as the feeder wheel rotates, the cam follower lever rides in the cam track and exerts torque against the shaft as dictated by the cam track. Thus, the suction device moves in the manner previously described.

On the circumferential edge of the feeder wheels, the carton selector feeds a collapsed carton to the carton opener. The carton opener includes a mechanism to releasably hold a portion of the carton. This mechanism could include a vacuum belt with a series of holes at stroke intervals. The vacuum belt is stretched between two pulleys that are arranged so that one side of the vacuum belt faces the feeder wheel and makes contact with folded cartons fed from the feeder wheel. On the side of the vacuum belt facing the feeder wheel, a plurality of nip rollers are provided. The nip rollers are spring-loaded to press against the vacuum belt so that a collapsed carton is held against and urged along by friction applied by the vacuum belt as the vacuum belt moves under power provided from a motor coupled to one of the two pulleys.

A carton opening wheel is positioned adjacent to the nip rollers, and has at least one suction device per stroke arranged at the circumferential edge of the carton opening wheel. The circumferential edge of the carton opening wheel has a stroke synchronized to the stroke of the vacuum belt. Substantially adjacent to the carton opening wheel, the vacuum belt is exposed to at least one vacuum chamber arranged between the two pulleys, the two sides of the vacuum belt and bearing blocks situated at the sides of the vacuum belt. The vacuum chambers communicate with the series of holes in the vacuum belt as the series of holes in the vacuum belt moves near or adjacent the carton opening wheel. Thus, through the series of holes in the vacuum belt, the vacuum chamber develops a suction on a first side or surface of the collapsed carton facing the series of holes in the vacuum belt. At the same time, the suction device of the carton opening wheel exerts a suction against a second side or surface of the collapsed carton, and rotates the suction device to at least partially unfold the carton. The carton is thus opened, and the suction device releases its grip on the second side of the carton as the carton pulls away from the carton opening wheel. The first side of the carton continues to be held and moved in a linear direction by the suction of the vacuum belt.

The rotational speed of the carton opening wheel can be controlled to vary during a complete rotation thereof, to account for different carton sizes or to optimize the carton opening action. Preferably, the rotational speed of the carton opening wheel decreases immediately after a suction device makes contact with a carton, and thereafter increases after a carton is pulled free of the suction device by the vacuum belt, to catch up to the stroke of the vacuum belt.

The carton erector includes first and second chains with respective leading lugs mounted at stroke intervals thereon. The first and second chains are positioned by respective sprockets. One sprocket for each of the first and second chains is arranged relative to the vacuum belt of the carton opener so that the lugs rotate around the sprockets into a position in the path of an opened carton advanced on the vacuum belt. To adjust for different carton sizes, the vacuum belt can be tilted as necessary to ensure that an opened carton will be driven into the lugs.

The vacuum belt is driven at a faster rate than the first and second chains so that a third side of the carton is driven into a pair of leading lugs on respective first and second chains. Third and fourth chains are situated adjacent to the first and second chains and are positioned and driven by respective sprockets. The third and fourth chains include corresponding trailing lugs coupled at stroke intervals. Respective sprockets of the third and fourth chains are arranged in proximity to the vacuum belt so that their respective trailing lugs rotate around the sprockets after an opened carton is driven into the leading lugs on the first and second chains. The trailing lugs thus rotate on the third and fourth chains about respective sprockets so that the trailing lugs are positioned behind an opened carton riding on the third and fourth chains. The carton is thus erected and held in position by the carton erector.

An object of the present invention is to provide a carton supply assembly or supply magazine capable of relatively high speed operation, that will reliably feed folded or collapsed cartons to a carton selector.

Another object of the present invention is to provide a carton supply assembly for a packaging machine which is positioned at or substantially at the packaging machine conveyor.

Another object of the present invention is to provide a carton supply assembly that maintains an approximately constant number of folded cartons in the carton selecting position with a weight sufficient to allow a carton selector to obtain a suction against the carton in the carton selecting position, but not so much weight as to render impossible the sliding of a selected carton out of the carton selecting position.

Another object of the present invention is to provide a carton selector that picks or selects a carton out of the carton selecting position along a linear pick line perpendicular to the surface of the carton to be selected, to allow a suction device moving along the pick line to obtain a sufficient suction against the surface of the picked carton before sliding the carton out of the carton selecting position.

Another object of the present invention is to provide a carton selector capable of relatively high speed operation, that will reliably select cartons for feeding to a carton opener.

Another object of the present invention is to provide a carton opener that applies a suction against two sides of a folded carton and pulls the respective sides in different directions to open the carton.

Another object of the present invention is to provide a carton opener that reliably feeds opened cartons to a carton erector with lugs to hold the opened carton in a predetermined, erect position.

Other objects, features and advantages of the present invention will become apparent upon reading the following specification in conjunction with the accompanying drawing figures.

DESCRIPTION OF THE PREFERRED EMBODIMENTS

Figure 1:
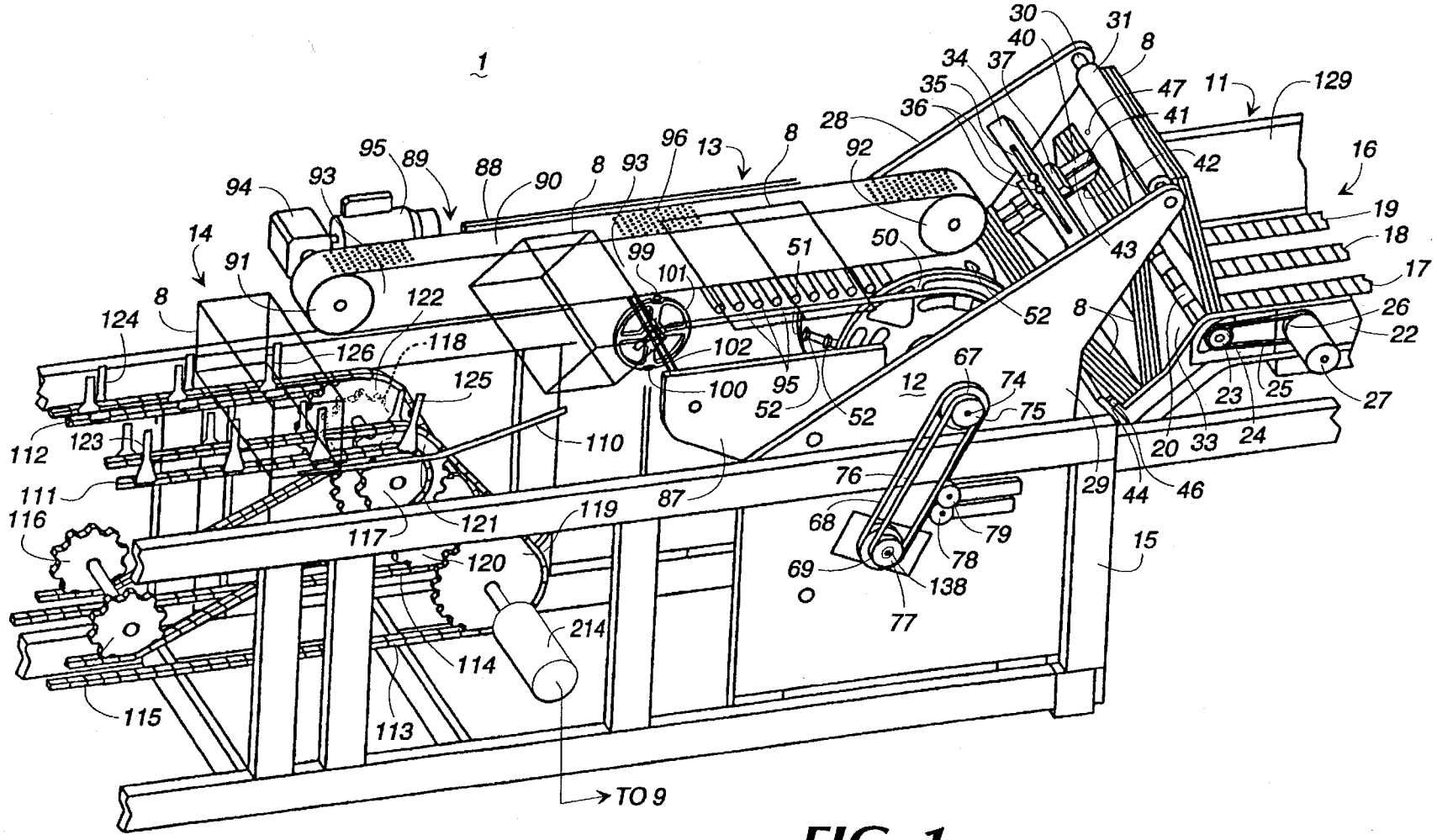
FIG. 1 is a perspective view of the carton feeder assembly of the present invention.

Referring now in detail to the drawing figures, wherein like reference characters denote like parts throughout the several views, FIG. 1 shows a carton feeder assembly 1. The assembly 1 includes a carton supply assembly 11, a carton selector 12, a carton opener 13 and a carton erector 14. The carton supply assembly 11, the carton selector 12, the carton opener 13, and the carton erector 14 are supported by a frame 15. The carton supply assembly 11 includes a carton feed conveyer 16 supported by the frame 15 so that the conveyer is below the operator's head level, and preferably positioned at about waist level to allow an operator to readily load folded cartons thereon. The conveyer 16 includes endless belts 17, 18 and 19 that rotate around a roller 20 and a roller 21 (not shown). The roller 20 is rotatably mounted at its ends in a conveyer frame 22. The roller 20 has an end 23 that extends through the conveyer frame 22. A sprocket 24 is coupled to the end 23. A chain or belt 25 is looped between a drive sprocket 26 coupled to a motor 27 that selectively operates to control movement of conveyors 17, 18 and 19.

A pair of side plates 28 and 29 are arranged at respective sides of the frame 15. A shaft 30 extends between upper portions of the opposing side plates 28 and 29, and is journaled at its ends. A roller 31 is rotatably mounted on shaft 30. Carton supply assembly 11 is loaded with collapsed cartons so that the cartons 8 have respective bottom folded edges resting on the belts 17, 18 and 19 while the top side of the cartons 8 are supported by the roller 31. The top sides of the cartons are also supported by the roller 31 in this position, and are considered to be in a 'carton supply position'.

At an end of the conveyer 16 in proximity to the roller 20 is a chute 33. The chute 33 can be formed integrally with the conveyer frame 22, or can be a separate assembly. The chute 33 is inclined downward away from conveyor 16 so that the bottom edges of cartons advanced beyond the end of the conveyer 16 slide down the chute 33 as the top sides of the cartons slide off of the top roller 31. Downstream relative to the roller 31 is a crossbar 34. The crossbar 34 has its respective ends fixed in opposing side plates 28 and 29. The crossbar 34 defines a slot 35 through which two retaining pins, such as screws, 36 extend. Screws 36 are threaded into a block 37 on one side thereof. On the opposite side of the block 37, a carton top holder 40 is fixed. The carton top holder 40 defines a slot 41 through which a threaded finger or tab 42 extends. A nut 43 is threaded onto tab 42 on one side of the carton top holder 40.

At the bottom of the chute 33, a roller frame 44 is provided. The roller frame 44 journals a plurality of rollers 46. The rollers 46 are arranged in a plane approximately perpendicular to a bottom surface of the chute 33. Cartons 8 that are supported on a side by the rollers 46 and on their bottom edges by the chute 33, are considered to be in a 'carton selecting or picking position'. Cartons with a top side supported by tab 42 and a bottom edge supported by the chute 33, are considered to be in a 'carton holding position'.

A detector 47 such as an electric photoeye, is arranged on the upward side of a plane defined between the surface of tab 42 and chute 33, or in other words by the front surface of a carton positioned so that its top edge contacts tab 42 and its bottom edge contacts chute 33 without bending the carton. The detector 47 is coupled to the conveyer motor 27, and detects whether a predetermined number of cartons are in the carton holding position. Assuming initially that no cartons are in the carton selecting position or the carton holding position, the detector 47 generates a signal that causes the conveyer motor 27 to drive the conveyer belts 17, 18 and 19 toward the chute 33. As the carton 8 is driven past the downstream edge of conveyer 16, that is adjacent chute 33, the bottom edge of the carton 8 slides down the chute 33 until the top side of the carton clears roller 31. The bottom edge of the carton continues to slide down the chute until the top side of the carton makes contact with tab 42. The top side of the carton is thus impeded by the tab, but because it is initially assumed that there are no cartons in the carton selecting position, the bottom edge of the carton continues to slide down the chute until the top edge of the carton clears tab 42. The bottom edge of the carton continues to slide down the chute until the side of the carton rests on the rollers 46. Since there are as yet no cartons in the carton holding position, the detector 47 continues to generate a signal activating the conveyer motor 27 to advance more cartons onto chute 33. The carton selecting position is filled when the height of the stack of cartons in the carton selecting position is high enough that the next carton from the conveyer 16 is trapped between the tab 42 and the bottom surface of the chute 33. Additional cartons from the conveyer 16 are stacked behind this trapped carton until the detector 47 detects that the carton holding position is filled with the predetermined number of cartons. At this point, the detector 47 deactivates its signal so that the conveyer motor 27 is also deactivated to stop advancing the conveyer 16.

As cartons are progressively selected from the carton selecting position, the height of the carton stack can become sufficiently low so that the bottom edges of one or more cartons in the carton holding position slide sufficiently down the chute 33 that their top edges clear the tab 42. These cartons thus drop from the carton holding position to the carton selecting position, ensuring that an approximately constant number of cartons are in the carton selecting position. If the height of the stack of the cartons in the carton holding position becomes lower than a predetermined height, the detector 47 detects this condition and generates its signal to activate the conveyer motor 27 to advance the conveyer 16 to drop additional cartons into the carton holding position. After sufficient cartons are in the carton holding position, the detector 47 again deactivates its signal to control the conveyer motor 27 to stop advancement of the conveyer 16.

The carton selector 12 includes two feeder wheels 50 and 51. The feeder wheel 50 has three suction devices 52 coupled to the feeder wheel 50 by respective motion defining assemblies 55 (not entirely shown in FIG. 1). The feeder wheel 51 has three suction devices 52 (not all of which are shown in FIG. 1) arranged to correspond with the suction devices 52 of the feeder wheel 50. The suction devices 52 are coupled to the feeder wheel 51 by respective motion defining assemblies 55. At their centers, the feeder wheels 50, 51 are rotatably mounted to a main shaft 64. The main shaft 64 is rotatably coupled to side plates 28, 29 via respective bearings 65 and 66 (not shown in FIG. 1). The end of the main shaft 64 protruding from the plate 29 is connected to a feeder driven pulley 67. A belt 68 couples the feeder driven pulley 67 to a feeder drive pulley 69.

The feeder drive pulley 69 is mounted to an air clutch 70, which is coupled to a reducer 71 and a motor 72 on the inside of the plate 29. Inside of the main shaft 64, a feeder adjustment screw 73 is rotatably mounted. The end 74 of the feeder adjustment screw 73 extends through the plate 29 and is mounted to a feeder adjustment driven pulley 75 situated adjacent to the feeder driven pulley 67. A belt 76 is looped around the feeder adjustment driven pulley 75 and the feeder adjustment drive pulley 77. The feeder adjustment drive pulley 77 is coupled to the motor 72. Tension wheels 78, 79 normally are fixed in a position to engage with the main drive belt 68 and the adjustment drive belt 76, respectively, so that the main drive belt 68 and the adjustment drive belt 76 have sufficient tension to rotate the feeder driven pulley 67 and the feeder adjustment driven pulley 75 at the same speed. To adjust the spacing between the feeder wheels 50 and 51, however, the air clutch 70 can be activated to disengage the feeder drive pulley 69 as the motor 72 drives the feeder adjustment drive pulley 77. Thus, the feeder driven pulley 67 will not rotate the main shaft 64, but will impart rotation to the feeder adjustment screw 73 either in a clockwise or counterclockwise direction, depending on whether the motor 72 rotates in a forward or reverse direction. Therefore, the feeder wheels 50, 51 can be brought closer together or further apart, depending on the direction of rotation of the motor 72. After adjustment of the spacing between the feeder wheels 50, 51 is completed, the air clutch 70 is deactivated so that the main shaft 64 and the feeder adjustment screw 73 will rotate together to maintain the spacing between the feeder wheels 50, 51. This lateral adjustment feature is explained in more detail hereinafter.

As the feeder wheels 50, 51 rotate on the main shaft 64, pairs of suction cups 80 rotate into a position facing the front surface of a carton 8 which is the first carton in the stack in the carton selecting position. When each pair of suction devices 80 reach a pick line that is radial to the feeder wheels 50, 51 and perpendicular to the side of the carton 8 in the carton selecting position, the pair of suction devices will advance along the pick line to make contact with the front surface of the first carton 8 in the carton selecting position. The weight of cartons 8 in the carton selecting position is sufficient to allow the pair of suction devices 80 to obtain a suction grip on the carton 8 to be picked, since the weight of the cartons 8 is exerted in a direction at least in part contrary to the direction in which the pair of suction devices 80 are advanced, due to the tilted attitude in which the rollers 46 hold the carton 8 in the carton picking position.

The pair of suction devices 80 suction and grip the carton 8 in the carton selecting position, and pull the carton radially along the pick line toward the circumferential edges of the feeder wheels 50, 51 until the folded edge of the carton 8 is past the edge of the carton top holder 40. The pair of suction devices 80 continue to retract along the pick line until the picked carton 8 is brought into contact with the circumferential edges of the feeder wheels 50, 51. At this point, the pair of suction devices 80 stop their movement along the pick line and rotate with the feeder wheels 50, 51. The picked carton 8 thus begins to move with the circumferential edges of the feeder wheels 50, 51. The picked carton 8 moves on the circumferential edges of the feeder wheels 50, 51 until the picked carton 8 is held against the feeder wheels 50, 51 by a spring-loaded main nip roller 86. At this time, the vacuum of the pair of suction devices 80 is released and the carton 8 is fed to the carton opener 13 between the feeder wheels 50, 51 and the main nip roller 86.

The carton opener 13 is supported by plates 87, 88 attached to the plates 28, 29, respectively. The plate 88 supports a vacuum belt unit 89 including a vacuum belt 90, a drive pulley 91, a free-running pulley or idler 92, a nylon bearing block 93, a gear box/reducer 94 and a motor 95. The motor 95 drives the vacuum belt 90 to rotate about the drive pulley 91 and the idler 92 via the gear box/reducer 94 that is coupled between the motor and the drive pulley to reduce the drive speed of the drive pulley relative to the drive speed of the motor. The vacuum belt 90 defines a series of spaced apertures 96 arranged at stroke intervals on the vacuum belt. The motor 95 is synchronized with the motor 72 so that the stroke of the vacuum belt is properly matched to the stroke of the feeder wheels 50, 51.

The feeder wheels feed a picked carton 8 to the vacuum belt so that a side of the carton 8 first fed from the feeder wheels 50, 51, faces a solid or non-apertured portion of the vacuum belt 90, and so that a side of the carton 8 last fed from the feeder wheels 50, 51 faces the apertures 96 in the vacuum belt. The carton is held into engagement against the vacuum belt by a plurality of nip rollers 97. The nip rollers 97 are spring-loaded to press against the vacuum belt so that the carton is urged along by the vacuum belt under force of friction.

As the carton is forced by the vacuum belt 90 toward the last or most downstream position of the nip rollers 97, the apertures 96 overlaying only the one side of the folded carton 8 are brought into communication with a vacuum chamber 98 situated inside of the bearing blocks 93. The suction applied to the side of the carton 8 continues to hold the carton into engagement with the vacuum belt 90 as suction also is applied to another side of the carton 8 that does not face the vacuum belt by a suction device 99 or 100 arranged at stroke intervals on a carton opening wheel 101. The carton opening wheel 101 is mounted on a shaft 102 rotatably mounted in bearings (not shown) in side plates 87 and 88. Mounted on plate 88, a motor 103 is coupled to an end of the shaft 102 via a gear box/reducer 104. As one of the suction devices 99 or 100 applies a suction grip to that side of the carton that does not face the vacuum belt 90, the carton opening wheel 101 rotates this carton side downward to open the carton as the vacuum belt 90 continues to apply suction to the first side of the carton facing the apertures 96. The carton 8 is thus opened. The vacuum belt 90 continues to move the carton in a linear direction so that the suctioned side of the carton 8 is eventually pulled free from the suction device 99 or 100.

The motor 103 and the gear box/reducer 104 are separate units from the motor 95 and the gear box/reducer 94, because the carton opening wheel 101 is preferably driven at varying speeds over a stroke interval. More specifically, the motor 103 is preferably controlled to rotate the carton opening wheel at a relatively slow speed after a suction device 99 or 100 makes contact with a carton 8 until the vacuum belt 90 drives the carton sufficiently far to pull the carton out of contact with a suction device 99, 100. After the carton is pulled away from a suction device, the motor 103 drives the carton opening wheel at a relatively high speed so that the proper stroke interval is maintained. However, it is possible (although not preferred) to drive the vacuum belt 90 and the carton opening wheel 101 together at the same constant speed, in which case the operation of motor 103 and the gear box/reducer 104 and the motor 95 and the gear box/reducer 94, can be combined together.

The carton erector 14 receives the opened carton 8 from the vacuum belt 90. The carton erector 14 includes a carton bottom flap guide 110 that guides the carton 8 into position on the carton erector 14 including leading lug chains 111, 112 and trailing lug chains 113, 114. The leading lug chains 111, 112 are positioned by sprockets 115, 116, 117, and 118, and the trailing lug chains 113, 114 are positioned by respective sprockets 119, 120, 121, 122. The sprockets 117, 121, 118, 122 are coaxially mounted. Leading lugs 123, 124 on the chains 111, 112 are arranged in pairs. As the sprockets 117, 118 rotate, respective lugs rotate around the sprockets 117, 118 into a position in the path of an opened carton 8 advanced by the vacuum belt 90. The vacuum belt 90 advances at a faster rate than the leading lugs 123, 124 on the chains 111, 112, and are moving so that the opened carton 8 is driven into a pair of leading lugs 123, 124 on respective chains 111, 112. A pair of trailing lugs 125, 126 then rotate around sprockets 121, 122 into position behind the opened carton 8. The opened carton 8 is thus erected between a leading lug 123, a leading lug 124, a trailing lug 125 and a trailing lug 126 and moved downstream to a cartoning operation. The opened carton 8 thus has four material sides (a bottom side resting on the trailing lug chains 113, 114, a side in contact with leading lugs 123, 124, a side in contact with the trailing lugs 125, 126 and a top side) and two open ends facing towards respective sides of the frame 15, through which articles or containers such as bottles or cans can be loaded into the open carton.

The relative phase between the leading lug chains 111, 112 and the trailing lug chains 113, 114 can be changed by advancing or retarding the leading lug chains 111, 112 relative to the trailing lug chains 113, 114. This feature provides the ability to adjust the leading lug chains 111, 112 and the trailing lug chains 113, 114 for different carton sizes.

Figure 2B:
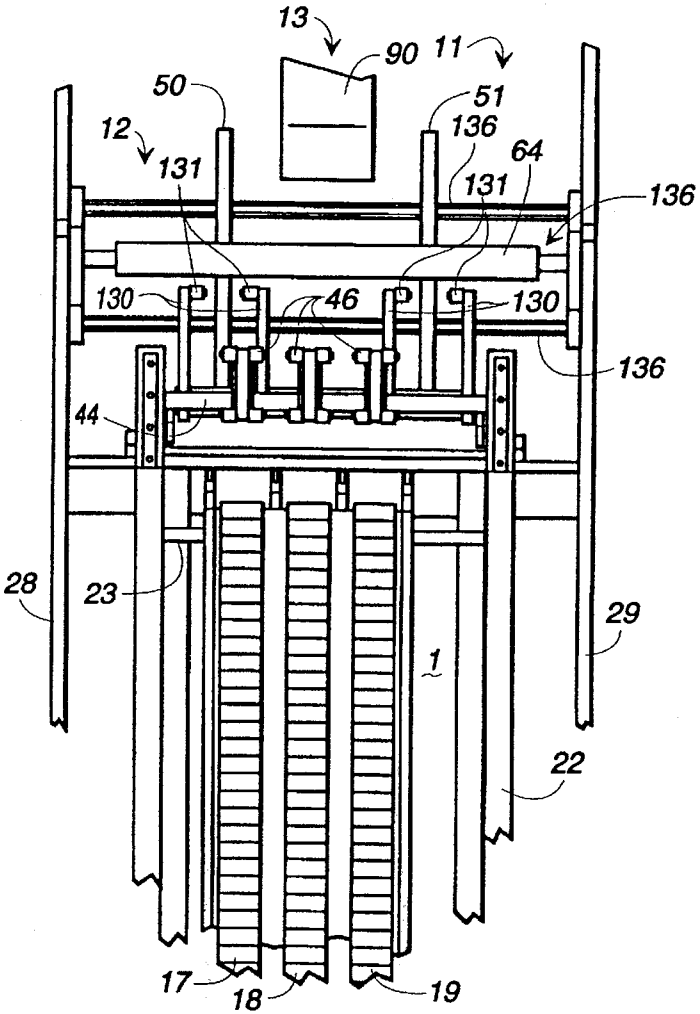
FIG. 2B is a top plan view of a carton supply assembly and portions of a carton selector.
Figure 2A:
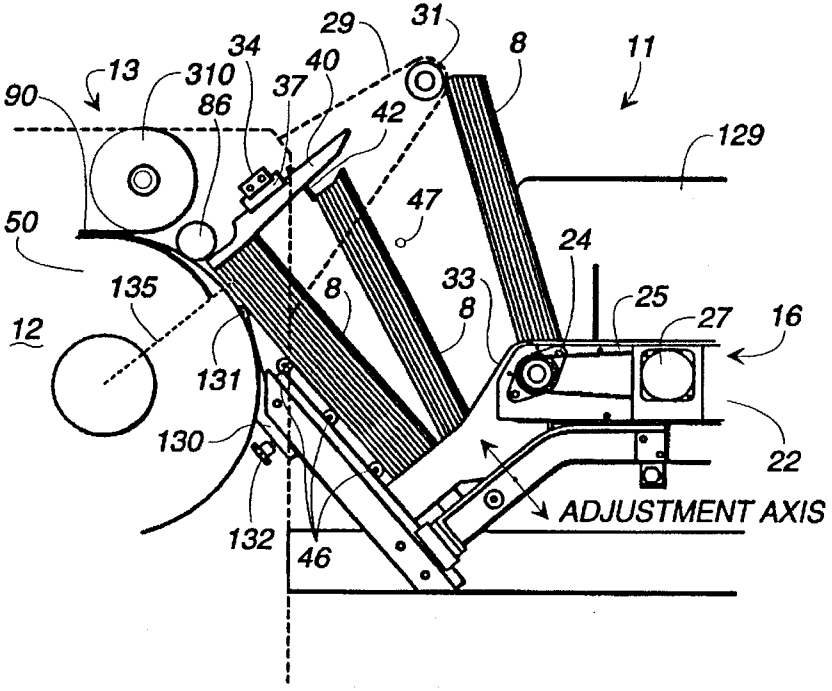
FIG. 2A is a side view a carton supply assembly and portions of a carton selector and a carton opener.

FIG. 2A is a side view of the carton supply assembly 11 and portions of the carton selector 12 and carton opener 13. Many of the elements in FIG. 2A were previously described with respect to FIG. 1. However, FIG. 2A illustrates some features not previously described with respect to FIG. 1. For example, to better contain the folded cartons 8 in the carton supply position, a conveyer siding 129 can be provided adjacent to the conveyer 16. FIG. 2A also illustrates important adjustment features for different carton sizes and thicknesses. Specifically, the carton feeder assembly 1 includes a member 130 supporting adjustable rollers 131. The member 130 can be adjusted in the plane of the rollers 46 by loosening and tightening a knob 132.

FIG. 2A also shows a pick line 135 along which a suction device 52 moves to make contact with a carton 8 in the carton picking position. Because two feeder wheels 50, 51 are preferably used, it should be understood that a pair of suction devices 52 do not move along the same pick line 135, but rather have respective pick lines 135 along which they move in the carton picking motion. The pick line 135 is radial to the feeder wheel 50 and perpendicular to a carton 8 in the carton picking position. A pair of suction devices 52 is advanced to make contact with carton 8 in the carton picking or selecting position along respective pick lines 135. As the pair of suction devices 52 retracts along the pick line 135, the carton is bent around the adjustable rollers 131 until the top edge of the carton clears the carton top holder 40 and is engaged with a rubber covering of the feeder wheels 50, 51 to cause the picked carton 8 to advance with the feeder wheels 50, 51. The adjustable rollers 131, the carton top holder 40 and the movement of the suction devices 52 thus ensures that only one carton will be picked, so that the system of the subject invention is relatively less subject to jamming resulting from picking and attempting to feed more than one carton. Also, due to the large carton support area provided by the rollers 46 and the adjustable rollers 131, the carton feeder assembly of this invention is less sensitive to bowed or bent cartons 8.

Although not shown in FIG. 1, FIG. 2A shows the main nip roller 86 that is spring-loaded to press against the circumferential edges of the feeder wheels 50, 51. Nip roller 86 ensures that a picked carton 8 is securely held against the feeder wheels 50, 51, and is properly urged to move with the circumferential edges of the feeder wheels 50, 51. From the main nip roller 86, a picked carton 8 is fed to the vacuum belt 90 of the carton opener 13.

In FIG. 2B, the top roller 31, the cross bar 34, the block 37, the carton top holder 40 and the main nip roller 86 have been removed to better illustrate the arrangement of the rollers 46 and the adjustable rollers 131. The rollers 46 are coupled to the roller frame 44 that is mounted to and supported by the conveyer frame 22.

In FIG. 2B, in addition to the feeder wheels 50, 51 and the main shaft 64, hex shafts 136 are illustrated. An additional hex shaft 136 is not illustrated in FIG. 2B as it is under and blocked from view by the main shaft 64. The structure and function of the hex shafts 136 are described below with respect to FIG. 3.

Figure 3:
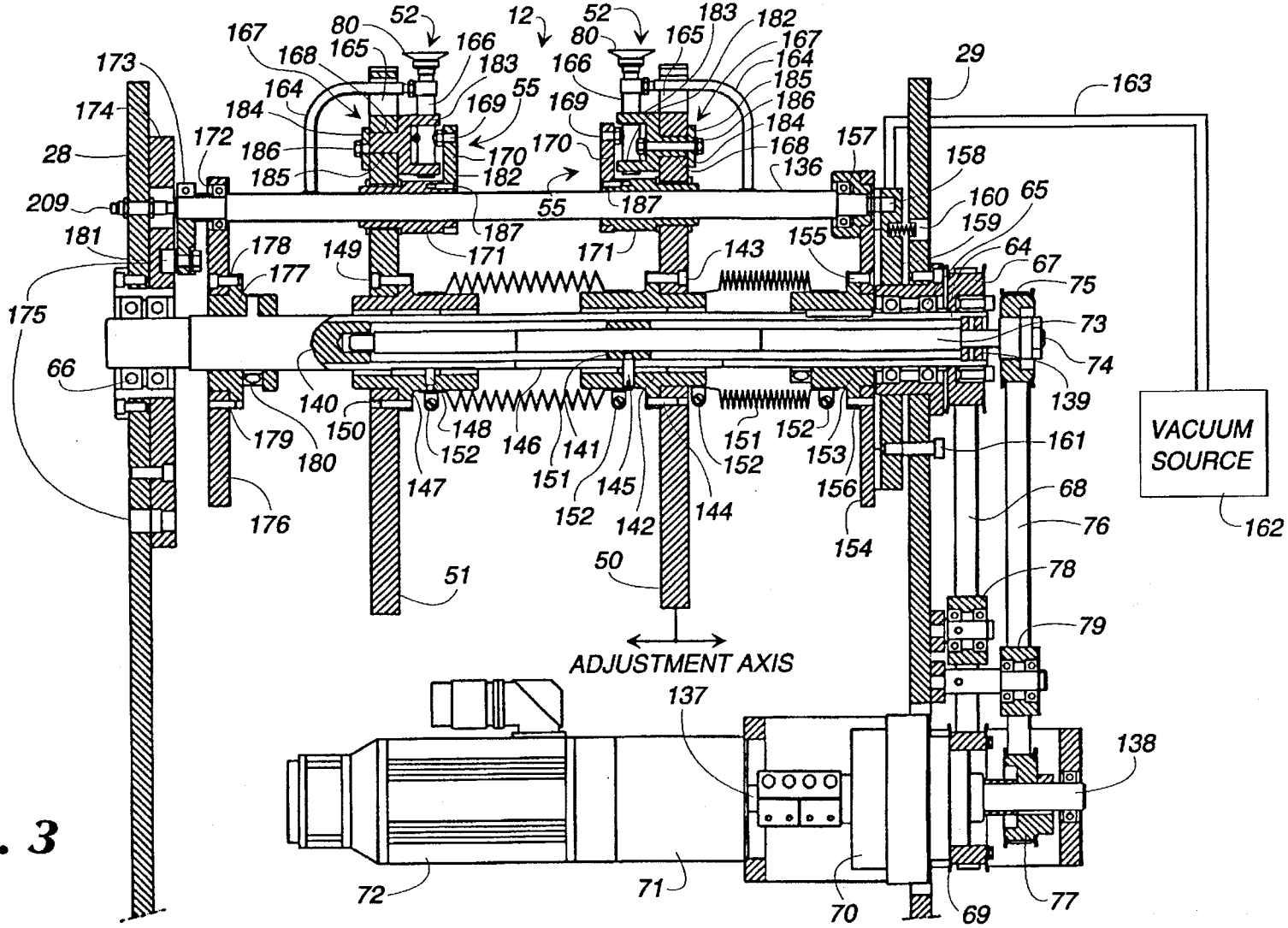
FIG. 3 is a cross-sectional view of a carton selector.

FIG. 3 is a cross-sectional diagram of a first embodiment of the carton selector 12 in accordance with the subject invention. The carton selector 12 is driven by the motor 72. Because the optimum speed range for the motor 72 is relatively high, the motor 72 is coupled to the reducer 71 that essentially includes gears with a gear ratio that reduces the rotational speed of an output shaft 137 relative to a motor 72. The output shaft 137 is coupled to the drive shaft 138 (the output shaft 137 can be the same as the drive shaft 138). The air clutch 70 selectively couples the output shaft 137 to the feeder drive pulley 69. The air clutch 70 is selectively engaged to couple the output shaft 137 to the feeder drive pulley 69 using a supply of compressed air.

Also fixed to the drive shaft 138 is a feeder adjustment drive pulley 77 coupled to the feeder adjustment driven pulley 75 via the belt 76. The feeder driven pulley 67 is coupled to the main shaft 64 and the feeder adjustment driven pulley 75 is coupled to the feeder adjustment screw 73. The feeder adjustment screw 73 is fixed inside the main shaft 64 at one end by bushing 139 and at the other end by bushing 140. The feeder adjustment screw 73 is also threaded through a nut 141 with an outer surface that can slide inside of the main shaft 64.

A coupler 142 is coaxial with and slidably mounted on the main shaft 64. The feeder wheel 50 is coupled to the coupler 142 with three screws 143 and a pin 144. A threaded pin 145 is threaded through the coupler 142 through a longitudinal slot 146 in the main shaft 64, to engage with the nut 141. A coupler 147 is coaxial with the main shaft 64 and fixed thereon with a threaded pin 148. The feeder wheel 51 is coupled to the coupler 147 with a screw 149 and a pin 150.

In normal operation, the main shaft 64 and the feeder adjustment screw 73 are driven by the motor 72 to rotate at the same speed. However, to adjust the lateral spacing between the feeder wheels 50, 51 for different carton sizes, the air clutch 70 can be activated to disengage the output shaft 137 from the feeder drive pulley 69. By controlling the motor 72 to rotate in the forward direction, the feeder adjustment screw 73 is driven to rotate in a forward direction via the feeder adjustment drive pulley 77 and the feeder adjustment driven pulley 75 while the main shaft 64 is relatively stationary. This causes the feeder wheel 50 to move along the main shaft 64 in a first direction determined by the threading of the feeder adjustment screw 73 and the nut 141. On the other hand, by driving the motor 72 in the reverse direction, the feeder wheel 50 moves along the main shaft 64 in a second direction (i.e., the opposite of the first direction) as determined by the threading of the feeder adjustment screw 73 and the nut 141. Thus, the spacing between the feeder wheels 50, 51 can be adjusted for a particular carton size. Normal operation is restored by releasing the compressed air supplied to the air clutch 70 so that the output shaft 137 engages with the feeder drive pulley 69. The main shaft 64 thus rotates with the feeder adjustment screw 73 so that the spacing between the feeder wheels 50, 51 is kept constant.

To prevent dust and the like from fouling the main shaft 64 or the feeder adjustment screw 73, a dust jacket bellows 151 is coupled between the couplers 142, 147 with screw clamps 152. On the main shaft 64 toward the end at which the feeder driven pulley 67 is fixed, a coupler 153 is coaxially mounted and fixed to the main shaft 64. Another bellows 151 is mounted with screw clamps 152 between the coupler 142 and the coupler 153 to prevent dust and the like from fouling the main shaft 64. A wheel 154 is coupled to the coupler 153 by three screws 155 and a pin 156. A bearing 157 is mounted in the wheel 154 to allow rotation at one end of the hex shaft 136. Similar bearings 157 are used to mount the other two hex shafts 136, respectively, to the wheel 154. The cross-section of FIG. 3 does not include the other two hex shafts 136 and associated pair of suction devices 52, but these elements are similar to the hex shaft 136 and associated suction devices 52 described below. The hex shaft 136 defines an internal chamber along its entire length, and has an end 158. The end 158 (as well as the other two hex shaft ends 158) is exposed to a vacuum disc 159 through respective apertures in the bearing 157 (as well as apertures in the other two bearings 157 for the respective ends 158) and the wheel 154. The vacuum disc 159 is urged against the wheel 154 by spring-loaded element 160. A shoulder screw 161 extends through the frame 29 and the vacuum disc 159 and prevents the vacuum disc 159 from turning with the wheel 154. A vacuum source 162 is coupled to the vacuum disc 159 by a hose 163 to draw air out of a space enclosed by the vacuum disc 159. Because the end 158 of the hex shaft 136 (and also the respective ends 158 of the other two hex shafts 136) communicates once each revolution of the wheel 154 with the space enclosed by the vacuum disc 159, air is also drawn out of the hex shafts 136, thus creating the suction of the suction devices 52.

More specifically, the hex shaft 136 is coupled to a flexible hose 164 at one end, and the flexible hose 164 is fed through an opening 165 in the feeder wheel 50. The opening 165 is provided to allow attachment of the hose 164 to the hex shaft 136 on the outside of the feeder wheel 50 to allow adjustment of the spacing between the feeder wheels 50, 51, for different carton sizes. The other end of the hose 164 is coupled to the hollow end of a vacuum rod 166 to provide suction in the suction cup 80 attached to the hollow end of the vacuum rod 166. The suction device 52 thus includes a suction cup 80 communicating with the vacuum source 162 to develop a suction. The other suction devices 52 likewise include respective suction cups 80 communicating with the vacuum source 162. The feeder wheel 51 includes similar elements to those described with respect to the feeder wheel 50, that is, a hose 164, a vacuum rod 166 with hollow end and a suction cup 80.

As previously noted, motion defining assemblies 55 are provided for respective suction devices 52. The motion defining assembly 55 includes the vacuum rod 166, a slide 167, a slot 168, a pin 169, a lever 170, a bushing 171, and a bearing 172. The motion defining assembly 55 of the first embodiment of the carton selector 12 differs from the second embodiment of the carton selector, by inclusion of the following elements. Specifically, the first embodiment of the carton supply selector 12 includes a cam follower lever 173 and a cam 174 with cam track 175. The bearing 172 is rotatably mounted in a wheel 176. The wheel 176 is fixed to a coupler 177 by three screws 178 and a pin 179. The coupler 177 is fixed to the main shaft 64 by a hub clamp 180. As the main shaft 64 rotates under torque applied by the motor 72, the feeder wheels 50, 51 and the wheels 154, 176 will rotate with the main shaft 64 in normal operation. The hex shaft 136 (as well as the other two hex shafts 136) will rotate with the feeder wheels 50, 51 and the wheels 154, 176. However, a cam follower roll 181 on cam lever 173 is constrained to ride in the cam track 175.

Thus, the cam 174 exerts a torque on the hex shaft 136 by forcing the cam follower roll 181 to follow the cam track 175. The torque exerted on the hex shaft 136 by the cam follower lever 173 and cam follower roll 181 as it rides in the cam track 175 causes the hex shaft 136 to rotate in a predetermined manner in the bearings 157, 172. Because the hex shaft 136 is coupled to the lever 170 via a screw 187 in the bushing 171, the lever 173 exerts a torque on the vacuum rod 166 via pin 169. Since the vacuum rod 166 is slidably mounted in flanges 182, 183, the torque exerted by the lever 170 is in turn exerted on the flanges 182, 183 to cause the slide 167 to slide in the slot 168. When the suction device 52 reaches the pick line 135 (not shown in FIG. 3) as the feeder wheels 50, 51 rotate, the cam 174 will cause the suction device 52 to rotate in the direction opposite to the rotation of the feeder wheels 50, 51 at a certain motion profile. This causes the suction device 52 to remain on the pick line 135. The movement of the slide 167 from one end to the other in the arcuate slot 168 also causes the suction device 52 to advance along the pick line until a suction established on a carton 8 in the carton selecting position, and causes the suction device 52 to retract with the picked carton 8 along the pick line until the carton 8 makes contact with the rubber-coated circumferential edges of the feeder wheels 50, 51. At this point, no torque is exerted on the hex shaft 136 by the cam track 175 so that the suction device 52 with the picked carton 8, rotate with the feeder wheels 50, 51.

The slide 167 includes a nylon plate 184 and a main slide body 185. The main slide body 185 primarily contacts with the inner side of the feeder wheel 50 and the plate 184 contacts with the outer side of the feeder wheel 50. The main slide body 185 and the plate 184 are held together by a bolt 186 running through the slot 168 and threaded into the main slide body 185. The main slide body 185 includes the first and second flanges 182, 183 preferably integrated therewith. Because the slide 167 is primarily composed of nylon, the slide 167 will readily slide in the slot 168.

Similar elements to those described with respect to the motion defining assembly 55 cause the suction devices 52 associated with the feeder wheel 51, to move along its respective pick lines in tandem with the suction devices 52 of the feeder wheel 50. The motion defining assemblies 55 associated with the feeder wheel 51 include a shaft 136, a bearing 172, a cam follower lever 173, and the cam 174 in common with the motion defining assemblies 55 for the feeder wheel 50. Because the elements and function of the motion defining assemblies 55 for the feeder wheel 51 are similar to those of the motion defining assemblies 55 for the feeder wheel 50, an explanation of these motion defining assemblies 55 is omitted as redundant.

Figure 4A:
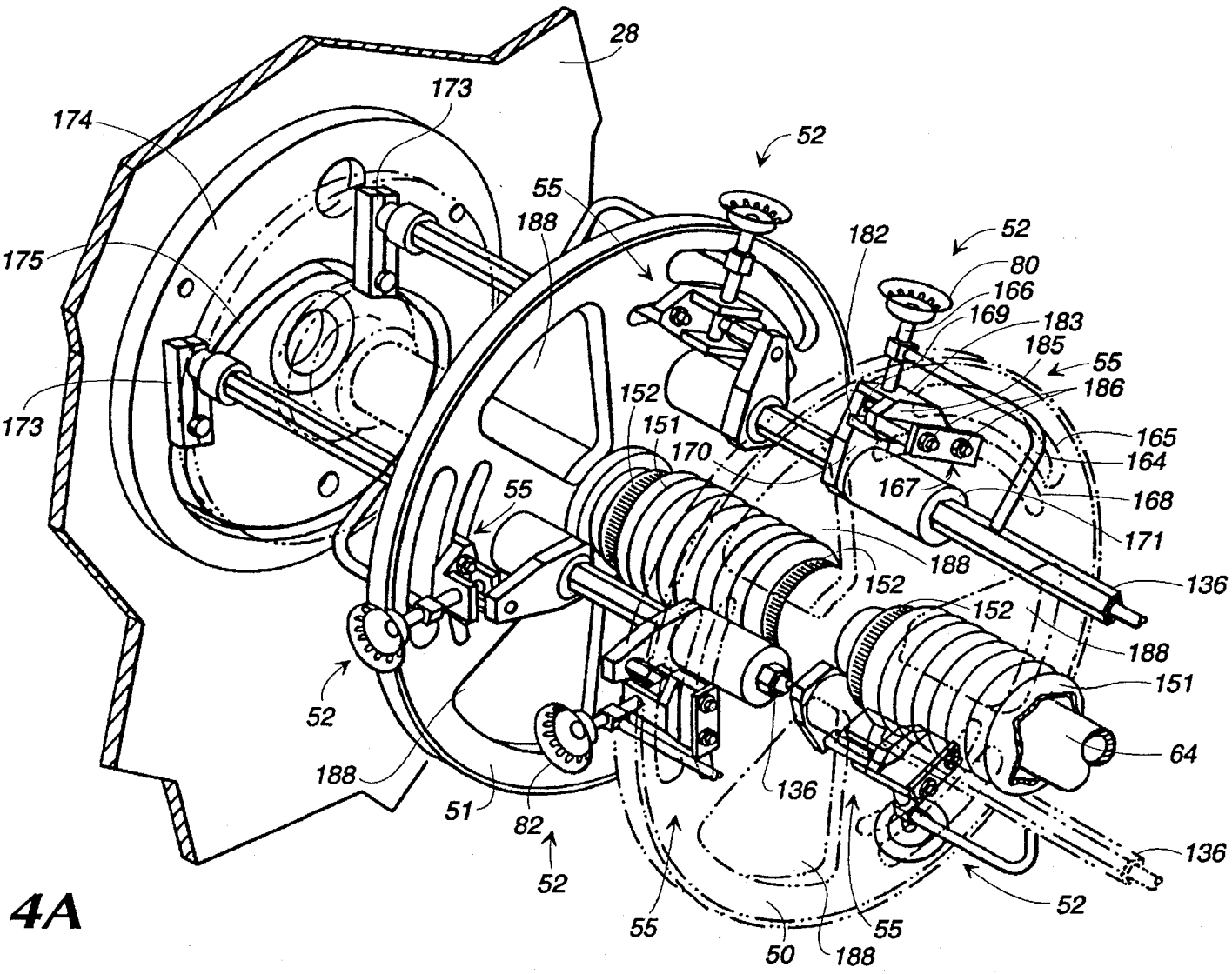
FIG. 4A is a perspective view of the feeder wheels, suction device and motion defining assemblies.

FIG. 4A is a perspective view of the first embodiment of the carton selector 12 in accordance with the subject invention. In FIG. 4A, the wheels 154, 176 and respective couplers 153, 177 have been omitted from the drawing to more clearly show the suction devices 52, and associated motion defining assemblies 55. One suction device 52 and most of its associated motion defining assembly 55 have not been illustrated in FIG. 4A as these elements are blocked from view by the main shaft 64. Most of the elements in FIG. 4A are similar to those described with respect to FIG. 3. Although not illustrated in FIG. 3, the feeder wheels 50, 51 have openings 188. The openings 188 are used to reduce the mass of the feeder wheels 50, 51.

Figure 4C:
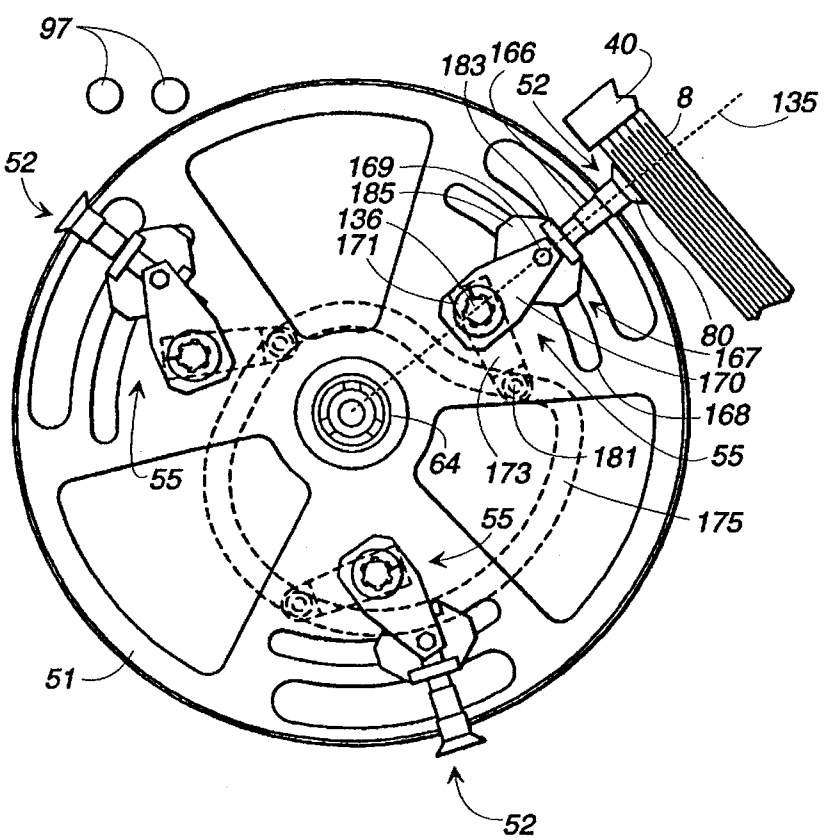
FIGS. 4B–4E are side views of the feeder wheel showing the selecting motion and motion preparatory to selecting, of the suction devices and respective motion defining assemblies.
Figure 4B:
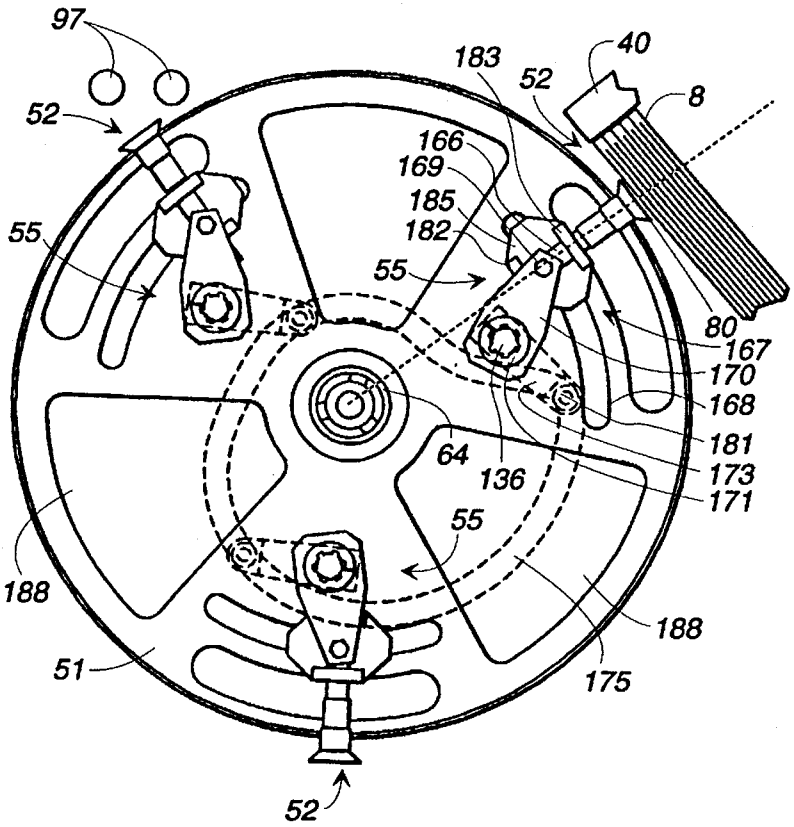

FIGS. 4B–4E illustrate the sequence of operations performed by the motion defining assemblies 55 with respective suction devices 52 in picking or selecting a carton 8 from the carton supply assembly 11. Because the motion defining assemblies 55 move their respective suction devices 52 in a similar manner to that described with respect to the motion defining assembly 55 in FIGS. 4B–4E, an understanding of a single motion defining assembly 55 and its functions will readily allow comprehension of the structure and functions of the other motion defining assemblies 55. In FIG. 4B, the feeder wheel 51 is rotating in the counter-clockwise direction. FIG. 4B shows the position of a suction device 52 just as the suction device 52 reaches the pick line 135 as the feeder wheel 51 rotates. The projection of the cam track 175 is shown in FIG. 4B. The roller 181 of the cam follower lever 173 exerts a torque on the hex shaft 136 that causes the hex shaft 136 to rotate bushing 171. This rotation causes lever 170 to rotate about the hex shaft 136 in the clockwise direction so that pin 169 stays on the pick line. Thus, the vacuum rod 166 and the suction cup 80 maintain their position on the pick line even as the feeder wheel 51 continues to rotate.

In FIG. 4C, the cam follower roll 181 continues to ride in the cam track 175 and exerts a torque rotating the hex shaft 136 and the bushing 171 so that the lever 170 is rotated in the clockwise direction on the hex shaft 136. The lever 170 is rotatably coupled to the slide 167 via pin 169. Because the slide 167 is in the middle of the arcuate slot 168, the pin 169 pushes the vacuum rod 166 so that the suction cup 80 is in its fully extended position in contact with the surface of the carton 8 in the carton picking position. The suction cup 80 is fully extended because the segment from the middle of the hex shaft 136 to the middle of the pin 169, and the segment from the middle of the pin 169 to the suction cup 80, are colinear (note that in FIG. 4B, these segments are not colinear, but bent at the pin 169 so that the distance from the middle of the hex shaft 136 to the edge of the suction cup 80, must be less than the sum of the two segments).

Figure 4E:
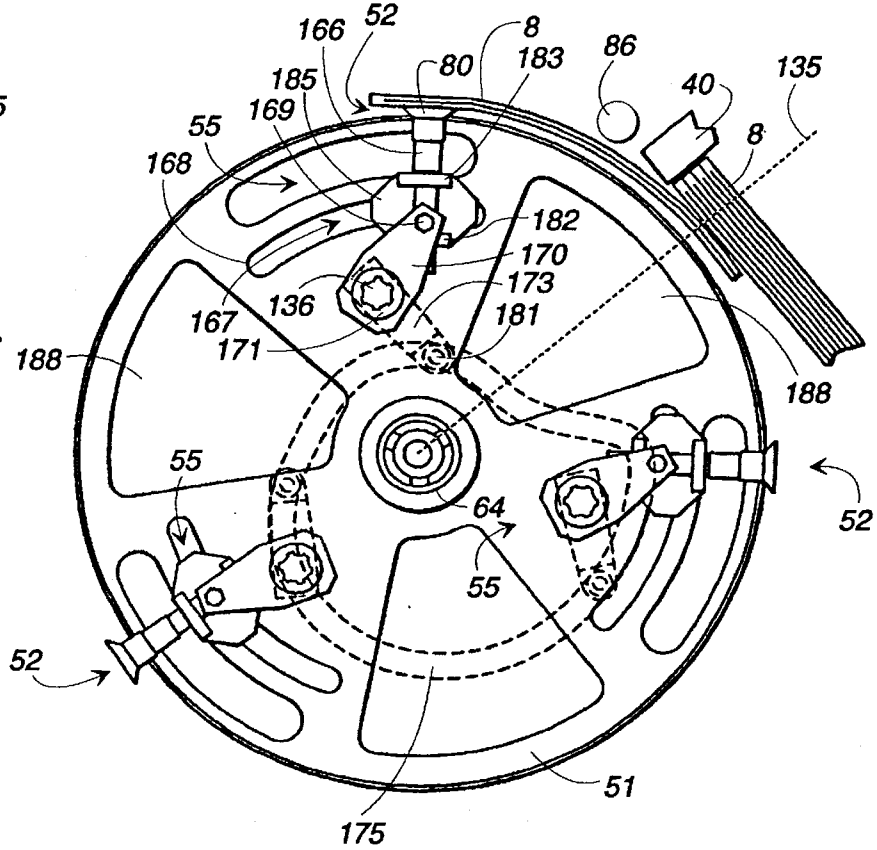
Figure 4D:
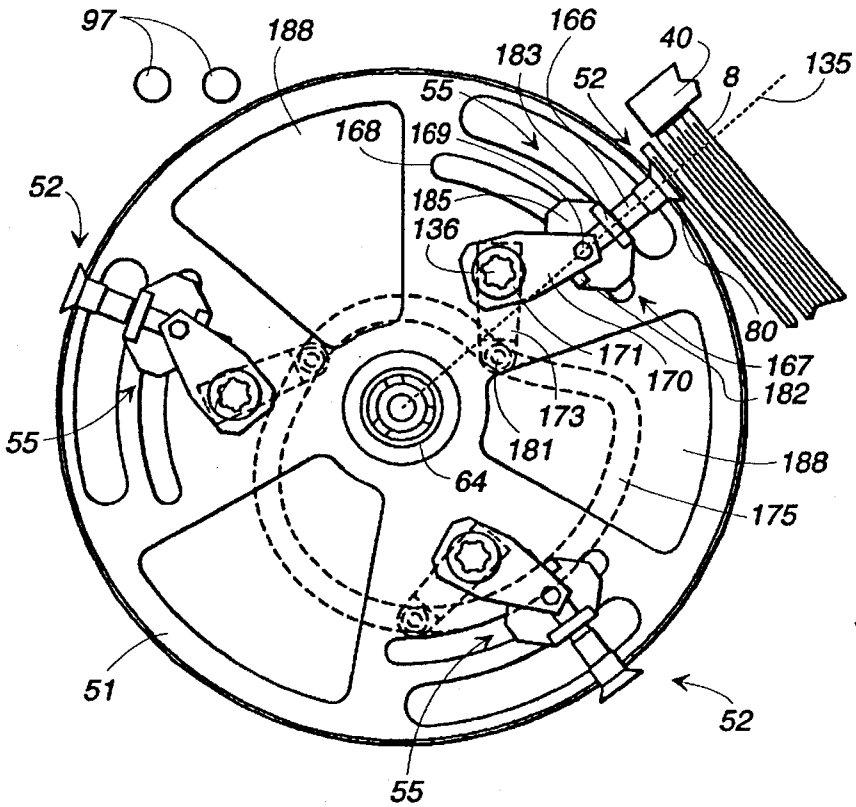

In FIG. 4D, the cam follower roll 181 continues to ride in the cam track 175 as the feeder wheel 51 rotates by torque imparted by the main shaft 64. The cam follower lever 173 exerts a torque on the hex shaft 136 as dictated by the cam track 175. The hex shaft 136 rotates the bushing 171 causing the lever 170 to rotate in a clockwise direction on the hex shaft 136. The lever 170 rotatably coupled to the slide 167 via pin 169 moves the vacuum rod 166 downward and therefore the slide 167, to the right in FIG. 4D toward the end of the slot 168. Because the distance from the hex shaft 136 to the pin 169 and from the pin 169 to the suction cup 80 is bent at the rotatable joint at pin 169, the suction cup 80 is retracted radially inward along the pick line toward the circumferential edge of the feeder wheel 51. The suction cup 80 continues to exert a suction grip on the picked carton 8 and pulls the picked carton 8 inward toward the feeder wheel 51 along the pick line past the edge of the carton top holder 40.

In FIG. 4D, the motion defining assembly 55 has driven the slide 167 as far in the clockwise direction as the slot 168 will allow. Accordingly, the suction device 52 rotates with the feeder wheel 51 in the counter-clockwise direction with the picked carton 8 still under suction grip applied by the suction cup 80. In FIG. 4E, the edge of the picked carton 8 is fed between the feeder wheel 51 and the nip roller 86 to the vacuum belt 90 and the nip rollers 97. The vacuum applied to the carton 8 by the suction device 52 is released before the carton 8 reaches the vacuum belt 90, to reduce wear on the suction cup 80.

After the carton 8 is released to be urged along by the vacuum belt 90 and the nip rollers 97, the motion defining assembly 55 must move the suction device 52 to be in the correct position to pick the next carton 8. To be in the correct position to pick another carton 8, the cam track 175 will impart a torque to the hex shaft 136 via the cam follower lever 173 and its cam follower roll 181, to impart a counter-clockwise torque on the hex shaft 136. This counter-clockwise torque causes the lever 170 to rotate in the counter-clockwise direction so that the slide 167 is moved in the slot 168 to the furthest extent possible in a counter-clockwise direction. In this manner, the slide 167 will be at the correct end of the slot 168 when the suction device 52 is rotated by the feeder wheel 51 again to the pick line to pick a carton 8 from the carton picking position. An understanding of this counter-clockwise movement of the slide 167 can be obtained by observing the motion of the other slides 167 in FIGS. 4B–4E as these slides 167 move in respective arcuate slots 168 to the correct position to begin the picking motion at the pick line 135.

Figure 5B:
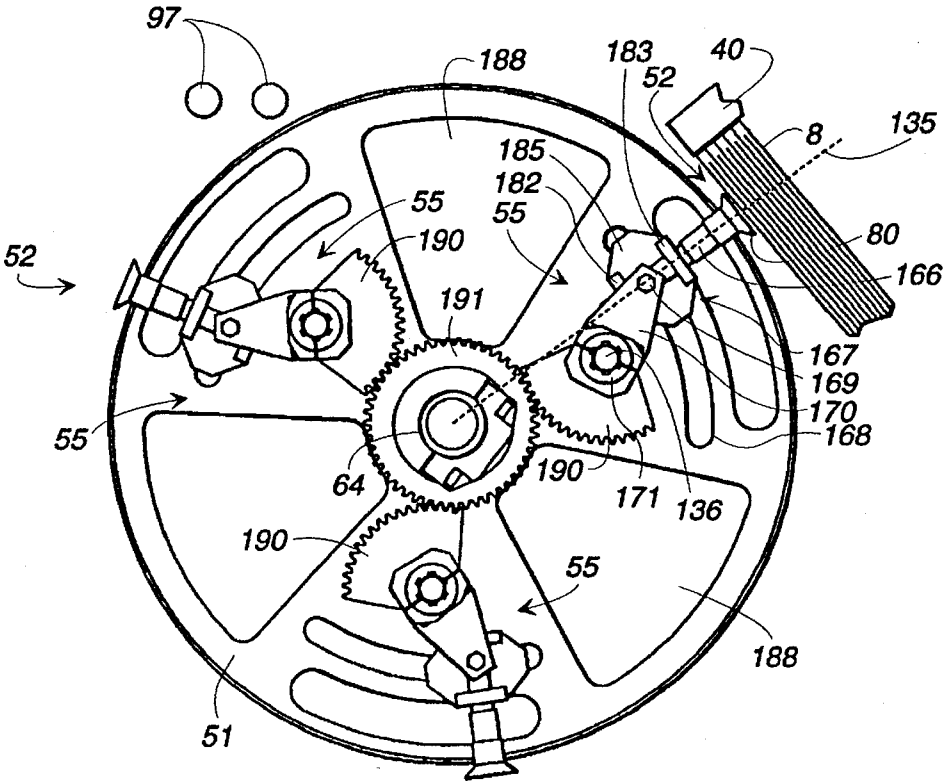
FIGS. 5B–5F are views showing the selecting motion and motion preparatory to selecting of a second embodiment of the motion defining assemblies of the carton selector.
Figure 5A:
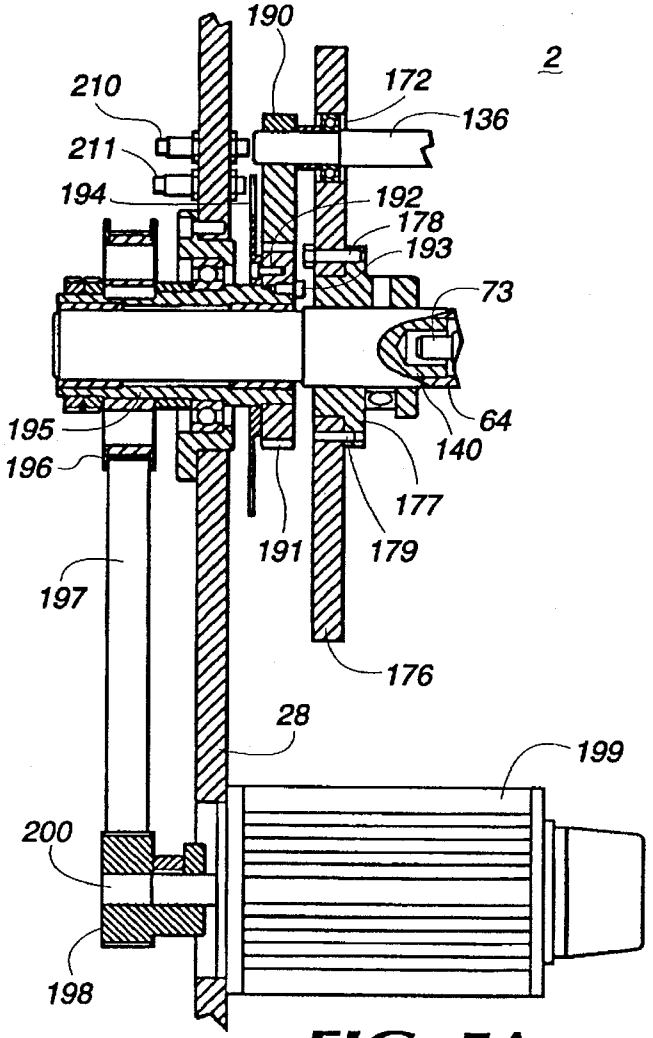
FIG. 5A is a cross-sectional view of a second embodiment of a motion defining assembly.

FIG. 5A is a cross-sectional diagram of a second embodiment of a portion of the carton selector 12 in accordance with the subject invention. The second embodiment of the carton selector 12 differs from the first embodiment in the structure and function used to realize the motion defining assemblies 55. Specifically, rather than using a cam 174 and a cam follower lever 173 as used in the first embodiment in FIGS. 3 and 4A–4E, the second embodiment of the carton selector 12 uses the elements described below. The elements described below are common to all motion defining assemblies 55. Therefore, the motion defining assemblies 55 will be understood by the explanation for a single motion defining assembly 55.

In FIG. 5A, the hex shaft 136 is coupled to a segmentary gear 190 with teeth meshing with the teeth of a sun gear 191. The sun gear 191 is coupled by screws 192, 193 to a homing plate 194 and a bushing 195, respectively. The bushing 195 is coupled to a pulley 196. A belt 197 is looped about the pulley 196 and a drive pulley 198. A servo-motor 199 is fixed to the frame 28 and has a shaft 200 for driving the pulley 198. The motor 199 thus rotates the hex shaft 136 via segmentary gear 190, sun gear 191, the bushing 195, the pulley 196, the belt 197, the pulley 198 and the shaft 200. The motor 199 thus causes suction devices 52 to move along respective pick lines in a manner similar to that previously described with respect to FIGS. 4B–4E.

FIGS. 5B–5F are a sequence of side views of the feeder wheel 51 illustrating the picking motion and motion to prepare for the picking motion of the second embodiment of the carton selector 12. In FIG. 5B, the servo-motor 199 (FIG. 5A) has just begun driving the sun-gear 191 in the counter-clockwise direction via the shaft 200, the drive pulley 198, the belt 197, the pulley 196, and the bushing 195. As the sun gear 191 rotates in the counter-clockwise direction, the segmentary gear 190 rotates in the clockwise direction about the shaft 136. The motion of the segmentary gear 190 thus exerts a torque on the hex shaft 136 so that the lever 170 also rotates in the clockwise direction about the hex shaft 136. The pin 169 rotatably couples the lever 170 to the vacuum rod 166 and forces the vacuum rod 166 to move in the clockwise direction guided by slide 167. Because the servo-motor 199 drives the vacuum rod 166 and the attached suction cup 80 in the clockwise direction as fast as the feeder wheel 51 rotates in the counter-clockwise direction, the suction device 52 maintains its position on the pick line.

Figure 5D:
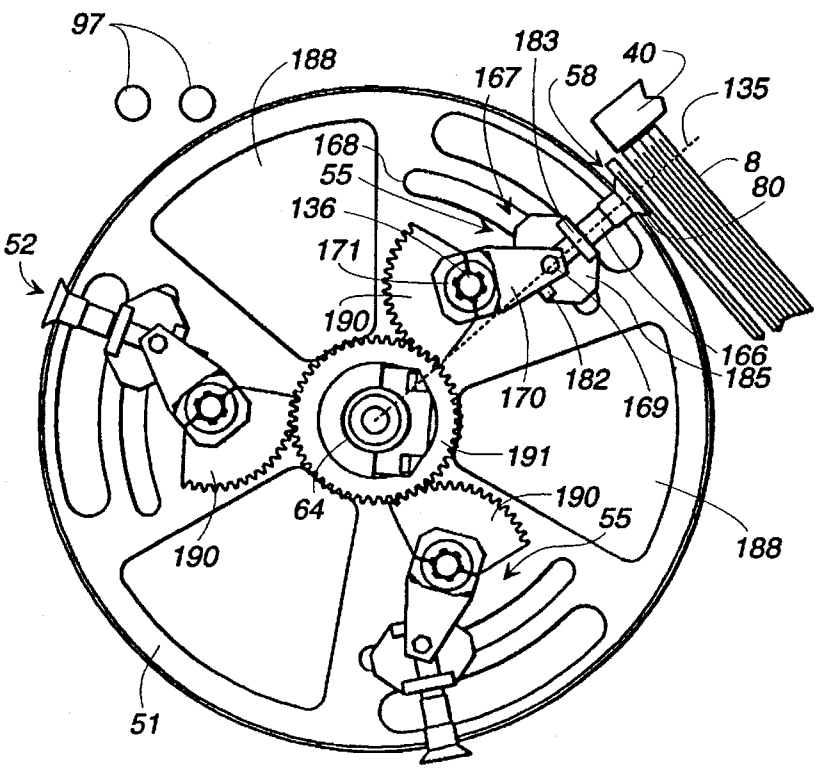
Figure 5C:
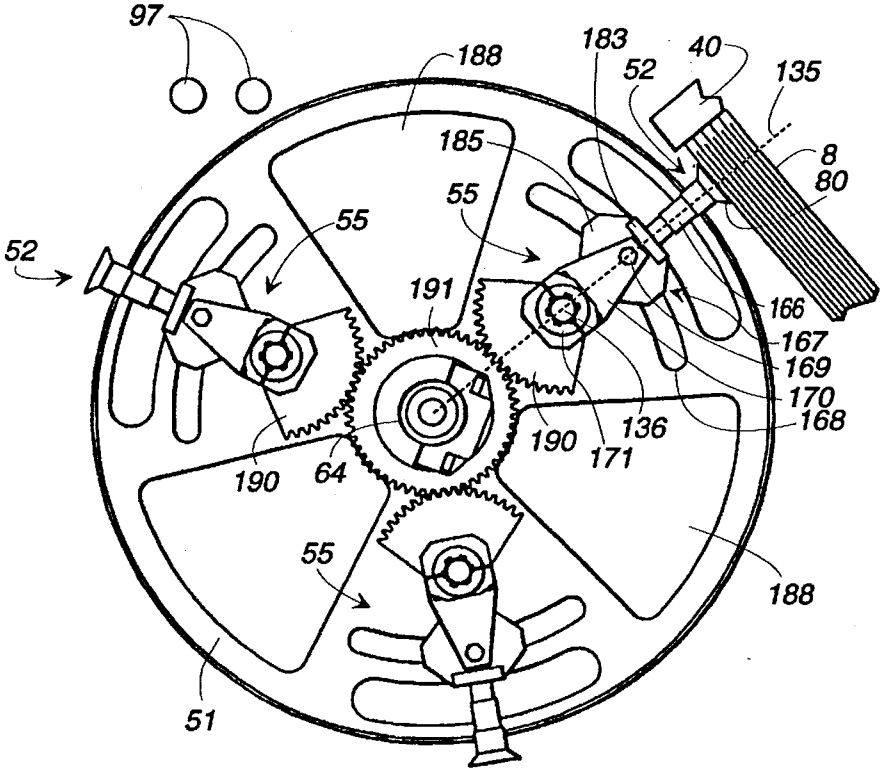

In FIG. 5C, the feeder wheel 51 has rotated in the counter-clockwise direction relative to FIG. 5B, and the servo-motor 199 continues to drive the sun-gear 191 and segmentary gear 190 so that the vacuum rod 166 and the suction cup 80 continue to rotate in the clockwise direction at the same velocity that the feeder wheel 51 rotates in the counter-clockwise direction. Thus, the suction cup 80 and the vacuum rod 166 remain in position on the pick line 135 and advance outward from the circumferential edge of the feeder wheel 51. This outward motion is affected because the segment from the middle of the hex shaft 136 to the pin 169 and the segment from the pin 169 to the suction cup 80 are at a maximum if the two segments are on the same line. In FIG. 5C, the slide 167 is in the middle of the slot 168 so that the two segments are on the pick line 135 and the suction cup 80 is positioned at its furthest extent outside the circumferential edge of the feeder wheel 51. The vacuum rod 166 thus pushes the suction cup 80 against the surface of the carton 8 in the picking position as the weight of the stack of cartons 8 in the picking position is exerted in a contrary direction against the suction cup 80, so that a firm suction grip can be obtained thereon.

In FIG. 5D, the servo-motor 199 has rotated the sun-gear 191 to the furthest extent possible in the counter-clockwise direction. The torque exerted by the sun gear 191 in the segmentary gear 190 causes the lever 170 to rotate about the hex shaft 136 to drive the slide 167 via the pin 169 and the vacuum rod 166, to one end of the slot 168. Because the segment from the center of the hex shaft 136 to the center of the pin 169 and the segment from the pin 169 to the suction cup 80 are bent at the pin 169 to the furthest extent, the distance from the center of the hex shaft 136 to the middle of the suction cup 80 is a minimum. Thus, the suction cup 80 is retracted inward to the circumferential edge of the feeder wheel 51 sufficiently to pull the picked carton 8 clear of the edge of the carton top holder 40. The sun gear 191 rotates counter-clockwise with the same speed as the feeder wheel 51 at least until the feeder wheel 51 is in the position shown in FIG. 5E.

Figure 5E:
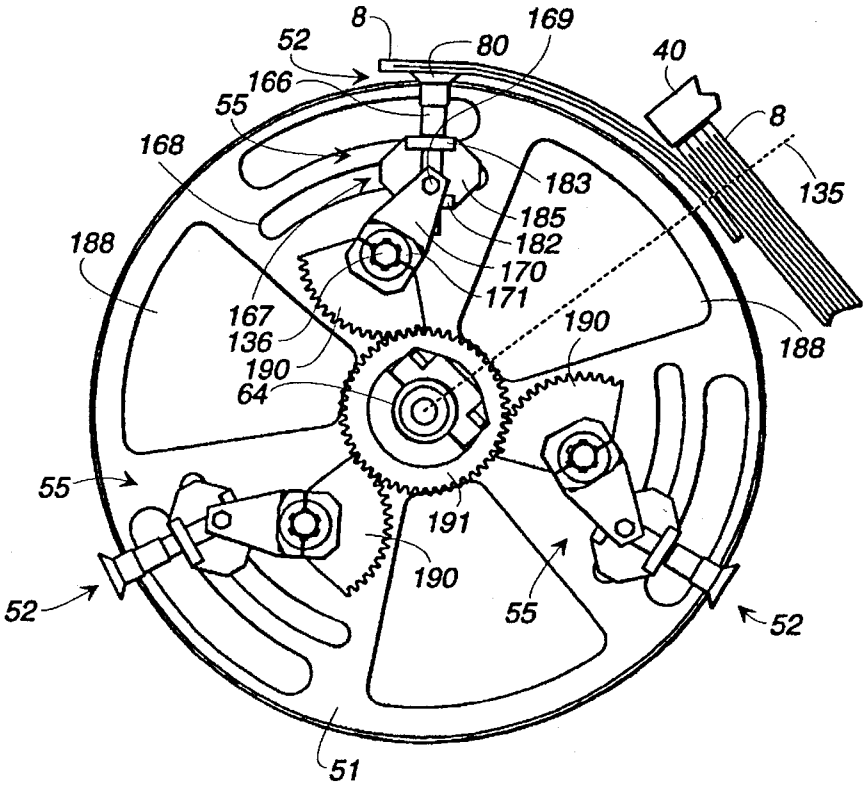
Figure 5F:
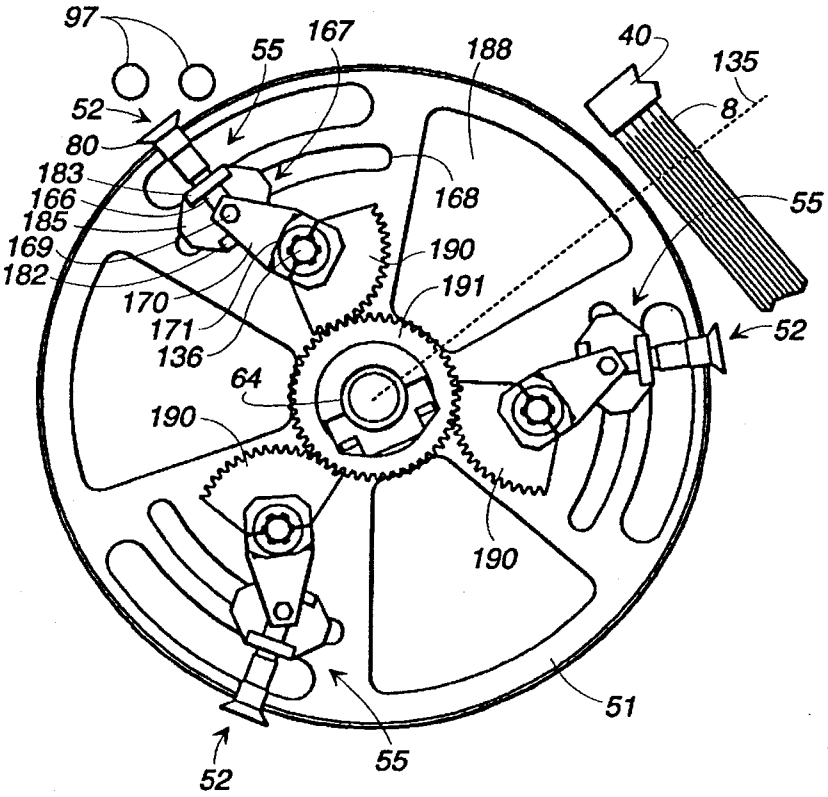

In FIG. 5E, the servo-motor 199 is driving the sun gear 191 in the counter-clockwise direction. Thus, the suction cup 80 rotates with the feeder wheel 51 and moves the picked carton 8 out of the carton picking position. The leading edge of the picked carton 8 is thus fed between the nip roller 86 and the circumferential edge of the feeder wheel 51, to the vacuum belt 90 and the nip rollers 97 that hold and urge along the picked carton 8. After the suction grip of the suction device 52 is released, but before the following suction device 80 rotates with the feeder wheel 51 into position on the pick line 135, the suction device 52 must be moved in the counter-clockwise direction into position preparatory to picking a carton 8. The servo-motor 199 thus drives the sun gear 191 in the clockwise direction until the slide 167 moves from the side of the slot 168 shown in FIG. 5E to the other side of the slot 168. This motion of the sun-gear 191 will also cause the other motion defining assemblies 55 to move their respective slides 167 from the sides of the slots 168. Thus, each motion defining assemblies 55 makes three picking motions and three motions to prepare for picking in one complete revolution of the feeder wheel 51. However, only one of the picking motions for each of the motion defining assemblies 55 will be along the pick line during a single revolution of the feeder wheel 51.

The hex shafts 136 are common to respective pairs of the motion defining assemblies 55 so that their respective motions are similar to those described with reference to FIGS. 5B–5F for the second embodiment of the carton feeder 2.

Figure 6A:
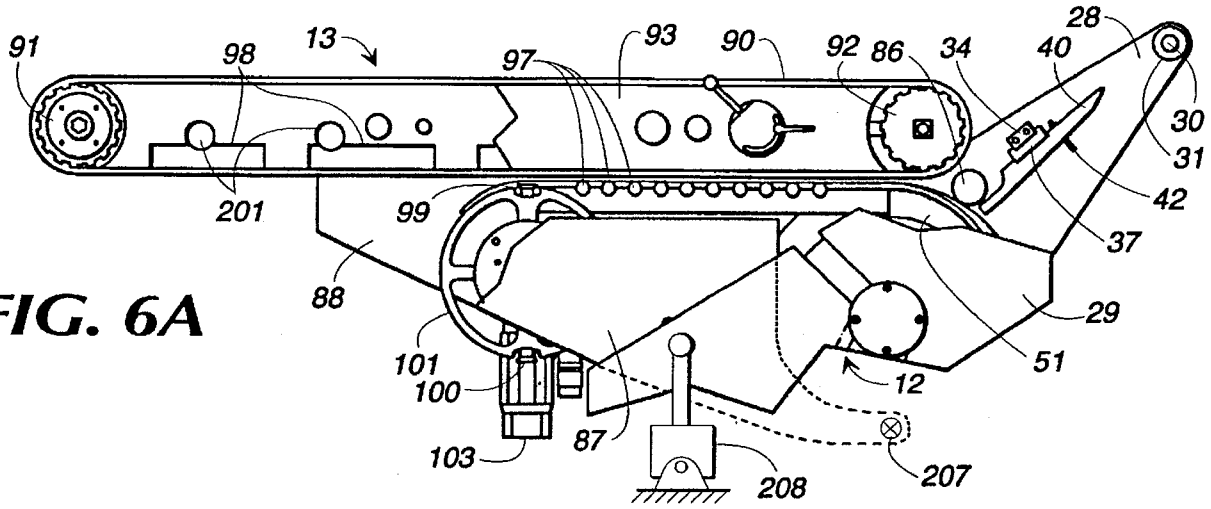
FIG. 6A is side view of portions of the carton feeder assembly, the carton selector and the carton opener.

FIG. 6A is a side view of portions of the carton supply assembly 11 and the carton selector 12, as well as the carton opener 13. The elements of FIG. 6A have been previously explained with respect to FIG. 1, however, worth noting is that the partial cut-away of the bearing block 93 allows viewing of the vacuum chambers 98 and associated vacuum motors 201 for generating a vacuum in the respective vacuum chambers 98.

Figure 6B:
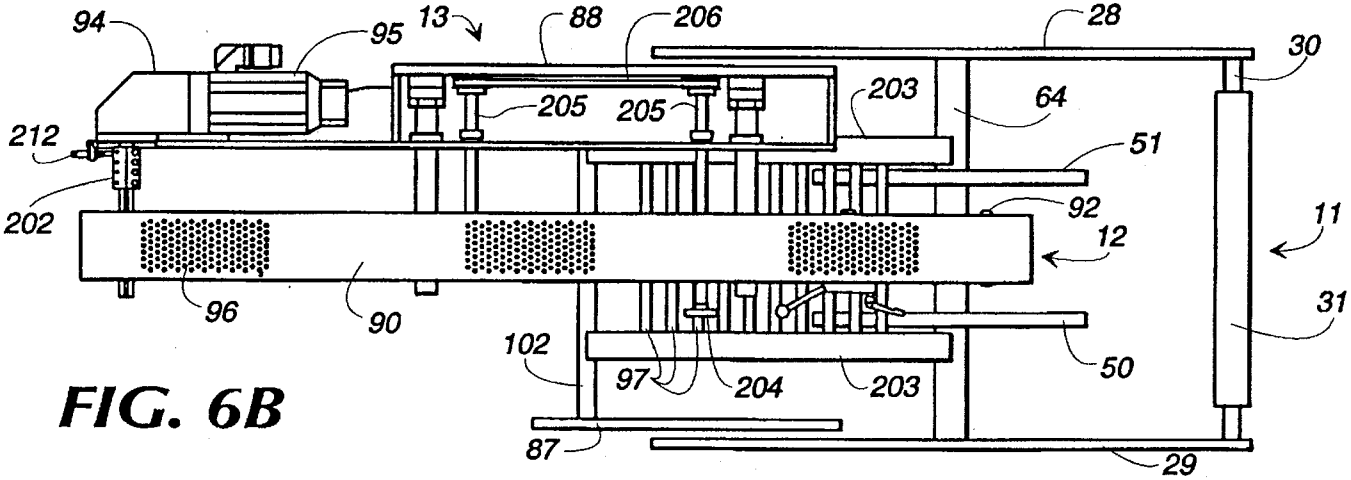
FIG. 6B is a top plan view of portions of the carton feeder assembly, the carton selector and the carton opener.

FIG. 6B is a top plan view of a portion of the carton supply assembly 11, the carton selector 12, and the carton opener 13. Most of the elements of FIG. 6B have been previously described with respect to FIG. 1 and FIG. 6A. In addition, FIG. 6B shows a shaft 202 coupled to the reducer 94 for driving the pulley 91. Also, mounts 203 for the nip rollers 97 are specifically shown in FIG. 6B. These mounts have a spring-loaded element for each of the nip rollers 97 so that the nip rollers 97 are urged to press against the vacuum belt 90.

The position of the bearing block 93 supporting the vacuum belt 90, can be adjusted for different carton sizes, for example, by turning a hand wheel 204 to move the bearing block 93 forward or backward (i.e. up or down in the plane of the page FIG. 6B) via an adjustment screw 205, a belt 206 and another adjustment screw 205. The adjustment screws 205 engage with the bearing block 93 to drive it forward or backward depending upon whether the hand wheel 204 is rotated in one direction or the other. This allows the bearing block 93 to be adjusted with the vacuum belt 90 so that they are centered with the carton 8.

Figure 7A:
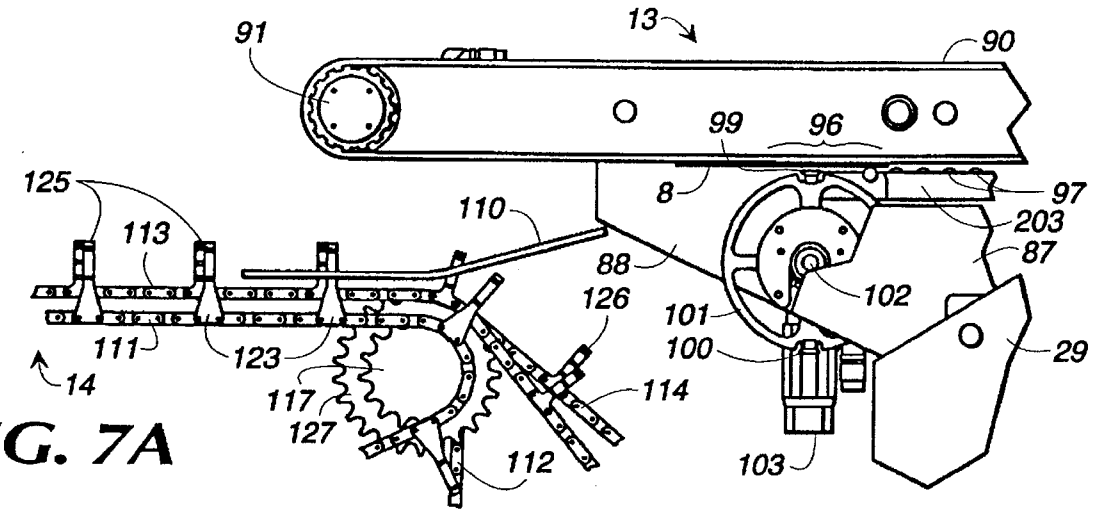
FIGS. 7A–7C are side views showing the carton opening and erecting motion of the carton opener and the carton erector, respectively.
Figure 7B:
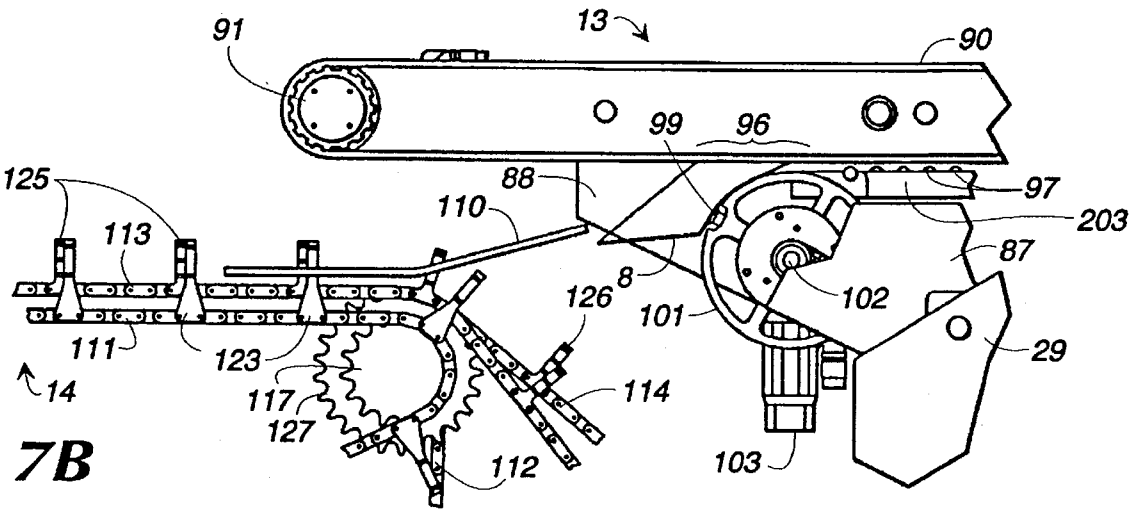
Figure 7C:
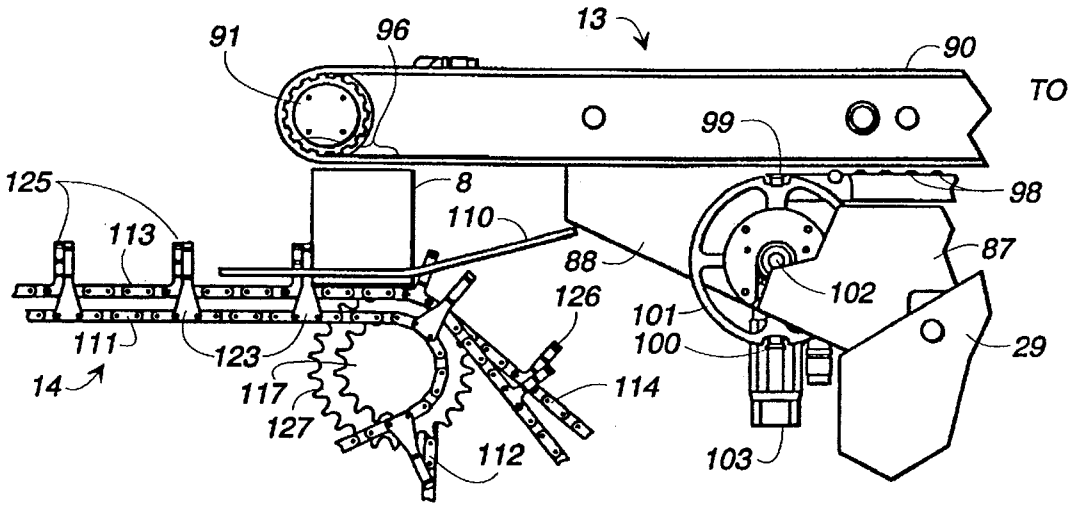

FIGS. 7A–7C illustrate a sequence of operations performed by the carton opener 13 and the carton erector 14. In FIG. 7A, a picked carton 8 is driven by the vacuum belt 90. The vacuum belt 90 is synchronized with the carton selector 12 so that as the vacuum belt 90 receives the picked carton 8, a series of holes 96 overlies one side of the picked carton 8 facing the vacuum belt 90, and so that another side of the picked carton is overlain by a solid portion of the vacuum belt 90. As the vacuum belt 90 nears the carton opening wheel 101, the holes 96 come into communication with a vacuum chamber 98 and thus exert suction on the side of the selected carton 8 facing the holes 96. The carton opening wheel 101 is synchronized with the movement of the vacuum belt 90 so that one of the suction devices 99, 100 rotates into position on a second side of the selected carton underneath the first side of the first carton. As the vacuum belt moves the first side of the carton in a linear direction along the vacuum belt while the carton opening wheel 101 applies a suction grip with one of the suction cups 99, 100 and rotates, the carton will begin to open as shown in FIG. 7B. More specifically, in FIG. 7B, the first side of the carton 8 is held by the suction applied through the series of holes 96 in the vacuum belt 90. Simultaneously, the carton opening wheel 101 continues to apply its suction via the suction device 99 as it rotates so that the carton 8 opens from its folded two-sided configuration to its opened four-sided configuration.

In FIG. 7C, the suction applied by the suction device 99 or 100 is released to allow the opened carton 8 to move with the vacuum belt 90. The vacuum belt 90 moves the opened carton 8 in the linear direction at a faster rate than the chains 111, 112, 113, 114 are driven by a motor (not shown). Thus, the carton 8 will be driven lightly into the leading lugs 123, 124 to erect the carton. After the carton is erected, a pair of trailing lugs 125, 126 rotate into position behind the carton so that the carton is held in an erect position between a pair of leading lugs 123, 124 and a pair of trailing lugs 125, 126. At this time, the suction applied to the top side of the erected carton is broken as the series of apertures defined in the vacuum belt 90 move out of communication with the vacuum chambers 98. Thus, the erected carton 8 moves on the chains 113, 114, in preparation for loading with articles such as bottles, cans, or other goods.

Operation and Control

1. Carton Size Adjustment

Before normal operation of the assemblies of the subject invention, an operator adjusts the system for the size of the cartons 8 that are to be used, if necessary. To adjust the carton supply assembly 11 for different carton sizes, the conveyor 16 can be lifted up or down with a lift motor (not shown). Also, the operator can loosen the knob 132 to slide the member 130 and attached adjustable rollers 131 into the correct position for the carton size and then tighten the knob 132 so that the adjustable rollers 131 are fixed in the proper position. The carton supply assembly 11 is thus adjusted for the carton size to be used.

The operator can adjust the carton selector 12 for the carton size to be used by using a compressed air supply to disengage the air clutch 70. By driving the motor 72 in the forward or reverse direction, the feeder wheels 50, 51 can be moved closer together or further apart to adjust for different carton sizes, as previously explained.

The operator can adjust the carton opener 13 by tilting the vacuum belt unit 89 about a pivot point 207 and fixing the vacuum belt unit 89 in the proper position. More specifically, an "Action Jack" gear reduction assembly 208 coupled between the floor upon which the carton opener 13 rests, or other fixed object, and the vacuum belt unit 89, can be extended or contracted by rotating a screw in the Action Jack 208 to tilt the vacuum belt unit 89 upward or downward to adjust for different carton sizes.

The carton erector 14 is adjusted in accordance with the carton size by shifting the relative phase between the leading and trailing lugs 111, 112, 113, 114 by advancing or retarding the leading chains 111, 112 relative to the trailing chains 113, 114 so that the intervals between lugs on each chain are appropriate for the carton size. This advancing or retarding of the leading chains 111, 112 relative to the trailing chains 113, 114 can be done by hand, for example, when the main machine motor (not shown) that drives the leading chains 111, 112 and the trailing chains 113, 114, is deactivated.

2. Homing and Preparation for Normal Operation

Figure 8:
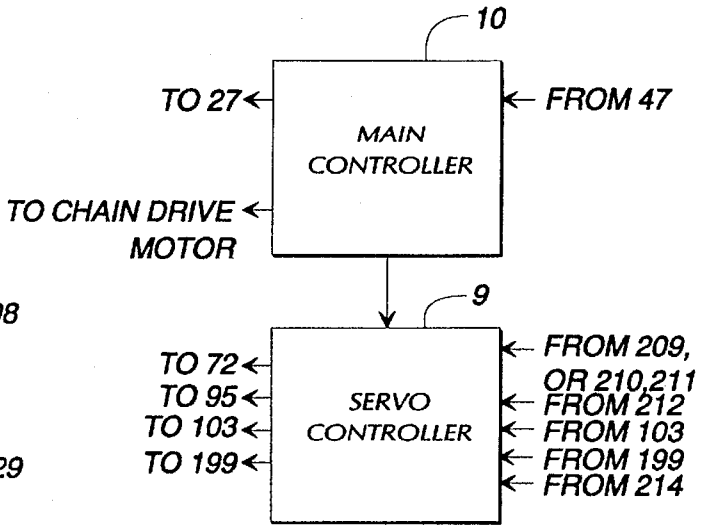
FIG. 8 is a block diagram of a main controller and a servo controller.

The homing, preparation for normal operation and normal operation modes of the carton feeder assembly 1 of this invention, are primarily controlled by a main controller 10, shown in FIG. 8. The main controller 10 controls the overall system of which this invention is a part. The main controller 10 also instructs at a general level the functions to be performed by the servo controller 9 that specifically controls the motor 72, the motor 199 (if the second embodiment of the motion defining assemblies 55 is used), the motor 95 and the motor 103. The main controller 10 and a servo controller 9 can each include a memory for storing control programs and temporary and permanent data, and a processor for generating control data based on the control programs, temporary and permanent data, etc., and/or signals and data received from sensors and controlled devices.

To prepare the carton selector 12, the carton opener 13, and the carton erector 14 for normal operation, the respective strokes of the carton selector, the carton opener, and the carton erector must be matched. This is done by homing the carton selector, the carton opener, and the carton erector so that their respective strokes will be synchronized when normal operation is commenced by the main controller 10.

If the first embodiment of the motion defining assemblies 55 is used, a homing detector 209 (see FIG. 3) coupled to the servo controller 9, is provided to detect the end of one of the hex shafts 136. In the homing operation, the servo controller 9 activates the motor 72 to rotate the shaft 64 until one of the ends of the hex shafts 136 is aligned with the homing detector 209. When the homing detector 209 generates a signal to the servo controller 9 indicating proper alignment, the controller 9 will stop the motor 72 from driving the shaft 64.

In the second embodiment of the motion defining assemblies 55, two homing detectors 210, 211 are provided as shown in FIG. 5A. The homing detectors 210, 211 are coupled to the servo controller 9. The servo controller 9 is coupled to drive the motor 199 until the homing detector 211 generates a signal to the servo controller 9 indicating alignment with the homing plate 194. The alignment of the homing plate 194 and the homing detector 211 establishes that the sun gear 191 is in a predetermined position. Then, the servo controller 9 activates the motor 72 to rotate the shaft 64 and the motor 199 to rotate the sun gear 191 until the homing detector 210 generates a signal to the servo controller 9 indicating alignment with the end of one of the hex shafts 136. When the detector 210 generates a signal indicating alignment with an end of one of the hex shafts 136, the servo controller 9 stops the motors 72 and 199 so that the carton selector 12 is in correct alignment for the start of normal operation of the system.

A homing detector 212 (See FIG. 6B) is provided in proximity to the shaft 202 of the vacuum belt 90 in the carton opener 13. The homing detector 212 generates a signal indicative of whether a pin 213 attached to the shaft 202 is aligned with the homing detector 212. The homing detector 212 is coupled to the servo controller 9, and the servo controller 9 is coupled to activate the motor 95 to drive the vacuum belt 90 until the detector 212 generates a signal indicating that the pin 213 is aligned therewith. At this time, the servo controller 9 deactivates the motor 95. The stroke of the vacuum belt 90 is thus matched to that of the carton selector 12.

The servo controller 9 is also coupled to the motor 103. The servo controller 9 rotates the motor 103 to the proper phase position using a phase signal generated by the motor 103, or by providing a homing plate (not shown) on the carton opening wheel with a homing detector (not shown) positioned relative to the carton opening wheel 101 to generate a signal if the homing plate is aligned with the homing detector so that the stroke of the carton opening wheel 101 is matched to that of the vacuum belt 90.

The main controller 10 controls a main machine motor (not shown) that drives the leading lug chains 111, 112 and the trailing lug chains 113, 114. Immediately before normal operation, the main controller 10 will cause the leading lug chains 113, 114 to begin moving via the main machine motor. The servo controller 10 is coupled to an encoder 214 that is coupled to a shaft of the sprocket 119, for example, and rotates therewith. When the encoder 214 indicates that the stroke of the leading lug chains 111, 112 and the trailing lug chains 113, 114 is matched to the carton selector 12 and the carton opener 13, the main controller 10 will instruct the carton selector 12 and the carton opener 13 to begin normal operation and synchronize their respective drives with the encoder 214.

The main controller 9 is coupled to the photoeye detector 47 to receive its output signal. The controller 10 is also coupled to the motor 27 to drive the motor 27 based on the signal from the detector 47. Before normal operation, an operator loads the conveyor 16 with cartons 8 by placing their bottom edges on the conveyor 16 and leaning their top sides so that they are supported by the roller 31. The operator activates the main controller 9 so that the carton supply assembly will fill its carton picking position and carton holding position with cartons 8. Assuming that no cartons 8 are initially in the carton picking position or the carton holding position, the detector 47 generates a signal to the controller 10 indicating that the carton holding position holding does not contain the predetermined number of cartons 8. Based on the signal from the detector 47, the servo controller 10 will control the motor 27 to advance the conveyor 16. Thus, the carton picking position is first filled with cartons 8, and then the carton holding position is filled with cartons 8 until the detector 47 generates a signal indicating that the carton holding position contains the predetermined number of cartons 8. The servo controller 10 then deactivates the motor 27 so that the conveyor 16 is not advanced. The system is thus ready for normal operation.

3. Normal Operation

In normal operation, the servo controller 9 will activate the motor 72, the motor 95, and the motor 103 to synchronize the drives of the carton selector 12 and the carton opener 13 to the main machine motor which drives the carton erector chains 111, 112, 113, 114, by following the encoder 214. As the carton selector 12 picks cartons 8 from the carton selecting position, the carton selecting position is supplied with cartons 8 from the carton holding position. The controller 10 will selectively advance the conveyor 16 to supply the carton holding position with additional cartons, based on the signal from the detector 47. A continuous supply of cartons 8 is thus fed to the carton selector 12.

If the first embodiment of the motion defining assemblies 55 is used in the carton selector 12, the carton selector selects cartons 8 one at a time from the carton holding position as the controller 9 controls the drive of the servomotor 72. In addition, if the second embodiment of the motion defining assemblies 55 are used in the carton selector 12, the controller 9 will also drive the motor 199 to affect the proper picking motions for the pairs of suction devices 52. Cartons picked by the carton selector 12 are fed by the feeder wheels 50, 51 to the carton opener 13 as the feeder wheels 50, 51 rotate.

The vacuum belt unit 89 receives the picked cartons and drives them in a linear direction and applies a suction to one side of the carton 8 with vacuum belt 90. The carton opening wheel 101 uses one of its suction devices 99, 100 to suction a side of the carton 8 as the carton opening wheel 101 rotates. As the vacuum belt 90 drives the carton 8 in a linear direction, the carton opening wheel 101 rotates with the side of the carton suctioned by a suction device 99, 100 so that the carton 8 is opened. Because the vacuum in the suction devices 99, 100 is eventually released, the vacuum belt 90 pulls the opened carton 8 out of engagement with the carton opening wheel 101.

Because the speed of the vacuum belt 90 is greater than that of the chains 111, 112, 113, 114, the vacuum belt 90 pushes the carton 8 lightly into the leading lugs 123, 124. The trailing lugs 125, 126 then rotate into position behind the opened carton 8 to hold the carton in an erect position. The above operations are continued carton-by-carton so that a continuous succession of erected cartons 8 ride on the chains 113, 114 for loading with bottles or cans and the like.

Although the subject invention has been described with specific illustrations and embodiments, it will be clear to those of ordinary skill in the art that various modifications may be made therein without departing from the spirit and scope of the invention as outlined in the following claims. For example, the motors 72, 95 and 103 could be combined as one motor, or the main machine motor (that drives the leading lug chains 111, 112 and the trailing lug chains 113, 114) could be used with line shafts to drive the carton selector 12 and the carton opener 13. Also, the vacuum belt 90 could be released with a lug chain or lug belt and a carton top flap guide. Further, the carton selector 12 could be made with various numbers of stations (i.e., motor defining assemblies) per feeder wheel. Thus, although this specification describes the carton selector 12 including three stations per feeder wheel 50, 51, other numbers of stations (1,2,4,5, . . .) could be used.

I claim:

1. A method of feeding and opening a carton, the carton being held in a carton supply position at a carton magazine, said method comprising the steps of:

a) positioning a spaced pair of generally parallel feeder wheels adjacent the carton magazine;

b) providing at least one suction device mounted on a support shaft extending perpendicularly between said feeder wheels for forming a carton selector assembly, and positioning said at least one suction device on said support shaft with respect to the periphery of each of said feeder wheels;

c) rotating said feeder wheels together in a first direction with respect to the carton magazine;

d) rotating said at least one suction device in a second direction opposite said first direction as said feeder wheels are being rotated in the first direction;

e) moving said at least one suction device along a carton pick line radial to said feeder wheels and the carton being held in the carton supply position;

f) extending said at least one suction device into a fully extended position along said pick line and engaging the carton in the carton supply position with said at least one suction device in response thereto;

g) moving said at least one suction device into a fully retracted position along said pick line toward the periphery of said feeder wheels, withdrawing the carton from the magazine along said pick line, and placing the carton on the periphery of said feeder wheels in response thereto; and h) feeding the carton placed on the periphery of said feeder wheels to a carton opener assembly.

2. The method of claim 1, further comprising the steps of:

a) positioning a vacuum conveyor belt at said carton opener assembly with respect to said feeder wheels;

b) moving the carton on the periphery of said feeder wheels into engagement with said vacuum conveyor belt and releasing the carton from said at least one suction device of the carton selector assembly in response thereto;

c) developing a first suction force between said vacuum conveyor belt and a first side of the carton;

d) providing a carton opening wheel positioned with respect to said vacuum conveyor belt;

e) developing a second suction force between a second side of the carton hingedly connected to said first side of the carton and at least one suction cup formed as a part of said carton opening wheel;

f) advancing the first side of the carton linearly on said vacuum conveyor belt while simultaneously rotating said carton opening wheel; and g) opening the carton in response thereto.

3. The method of claim 2, further comprising the steps of:

a) moving a third side of the carton hingedly connected to said first side of the carton against a first lug on a carton transport conveyer; and b) moving a second lug spaced from said first lug on said conveyor against the second side of the carton and holding the carton in place on the conveyer in response thereto.

4. The method of claim 2, further comprising the steps of moving said vacuum conveyor belt at a first velocity and moving said carton transport conveyor at a second velocity less than said first velocity.

5. The method of claim 4, comprising the steps of rotating said feeder wheels at said first velocity, and rotating said carton opening wheel at a variable velocity with respect to said first velocity.

6. The method of claim 1, further comprising the step of increasing and decreasing the distance between said spaced pair of feeder wheels.

7. A method of opening a carton comprising the steps of:

a) developing a first suction force between a spaced series of vacuum openings defined in the surface of an endless vacuum conveyor belt and a first side of a carton;

b) developing a second suction force between a second side of the carton hingedly connected to the first side of the carton and at least one suction cup formed as a part of a carton opening wheel positioned with respect to said vacuum conveyor belt;

c) advancing the first side of the carton linearly on the vacuum belt;

d) simultaneously rotating the carton opening wheel; and e) opening the carton in response thereto.

8. The method of claim 7, further comprising the steps of:

a) forcing a third side of the carton hingedly connected to said first side of the carton against a first lug on a conveyer;

b) positioning a second lug spaced from said first lug on the conveyer against the second side of the carton; and c) holding the carton in place on the conveyer in response thereto.

9. An apparatus for opening a carton, the carton having a first side and a second side and a third side each hingedly connected to the first side, the apparatus having an elongate framework, said apparatus comprising:

an endless vacuum belt supported on the framework, said vacuum belt having a spaced series of vacuum holes defined in the surface thereof and being sized and shaped for communication with at least one vacuum chamber supported on the framework, said at least one vacuum chamber being generally sealed on at least a portion of said vacuum conveyor belt for creating a first suction force against the first side of the carton;

a carton opening wheel supported on the framework with respect to said vacuum conveyor belt, said carton opening wheel having at least one suction cup for creating a second suction force on the second side of the carton; and means for varying the speed of said carton opening wheel with respect to the speed of said vacuum conveyor belt for opening the carton.

10. The apparatus of claim 9, further comprising:

a first drive motor coupled to the vacuum conveyor belt and a second drive motor coupled to the carton opening wheel, said first motor being constructed and arranged to drive the vacuum conveyor belt to advance the first side of the carton in a generally linear direction as said second motor rotates the carton opening wheel and said at least one suction cup thereon in substantially the same direction as said vacuum conveyor belt for opening the carton.

11. The apparatus of claim 10, further comprising:

a plurality of spaced and generally parallel nip rollers supported on the framework with respect to the carton opening wheel and being closely spaced from the surface of said vacuum conveyor belt, said nip rollers being constructed and arranged to hold the carton against the vacuum conveyor belt as the carton is moved by said vacuum conveyor belt toward the carton opening wheel.

12. The apparatus of claim 10, wherein said first drive motor drives the vacuum belt at a first velocity, and including a chain conveyer supported on the framework and having a spaced series of spaced lugs thereon, said chain conveyor having a sprocket about which the chain conveyor turns, said sprocket being positioned with respect to the vacuum conveyor belt so that said chain conveyor is generally aligned with said vacuum conveyor belt, said chain conveyor being driven by a third drive motor at a second velocity less than said first velocity so that the third side of the carton is moved against a first lug of said spaced series of lugs by said vacuum conveyor belt and a second lug is rotated about the sprocket and is moved against the second side of the carton for holding the carton on said chain conveyor.

13. The apparatus of claim 9, wherein said vacuum conveyor belt is pivotally mounted on the framework of the apparatus at a pivot point, said apparatus including at least one action jack coupled between the framework of the apparatus and the vacuum conveyor belt, said action jack being constructed and arranged to rotate the vacuum conveyor belt relative to the framework of the apparatus about said pivot point to adjust the apparatus for different sizes of cartons.

14. A carton feed and opening machine, each carton having a first side wall and a second and a third side wall each hingedly connected to the first side wall of the carton, said machine comprising:

an elongate framework having an infeed end, a discharge end spaced from said infeed end, and a path of travel extending from the infeed end toward the discharge end of the machine;

a carton magazine supported on the infeed end of said framework, said carton magazine having a supply of pre-scored and folded cartons with at least one folded carton being held in said magazine in a carton supply position for being removed from said magazine;

a carton selector assembly supported on said framework, said carton selector assembly being positioned with respect to said carton magazine and having a spaced pair of generally parallel feeder wheels supported for rotation on a main shaft mounted on said framework, a plurality of support shafts extending between said feeder wheels, each of said support shafts being rotatably supported on said feeder wheels, and at least one suction device supported on each said support shaft for engaging said at least one folded carton in said carton supply position;

means for rotating said feeder wheels in the direction of the path of travel, each of said at least one suction cups on each of said support arms being constructed and arranged to rotate in a direction opposite the direction of the path of travel as said feeder wheels are rotated;

an endless vacuum conveyor belt positioned on said framework with respect to said carton selector assembly for receiving folded cartons from said feeder wheels;

a carton opening wheel assembly positioned on said framework with respect to said vacuum conveyor belt for receiving one of the sides of the folded cartons from said vacuum conveyor belt and opening the cartons in response thereto; and a chain conveyor supported on said framework and extending in the direction of the path of travel toward the discharge end of the machine, said chain conveyor being constructed and arranged to receive opened cartons from said vacuum conveyor belt and said carton opening wheel assembly for erecting the cartons on the chain conveyor.

15. The carton feed and opening machine of claim 14, further comprising a first drive means for moving said vacuum conveyor belt in the direction of the path of travel at a first velocity, and a second drive means for rotating said carton opening wheel in the direction of the path of travel.

16. The carton feed and opening machine of claim 15, wherein said second drive means is constructed and arranged to vary the speed of the rotation of said carton opening wheel in the direction of the path of travel with respect to said first velocity of said vacuum conveyor belt.

17. The carton feed and opening machine of claim 15, further comprising a third drive means for moving said chain conveyor in the direction of the path of travel at a second velocity, said second velocity being less than said first velocity of said vacuum conveyor belt.

18. The carton feed and opening machine of claim 14, wherein each said at least one suction cup on each said support arm is constructed and arranged to reciprocably move along a radial pick line extending from the main shaft of the carton selector assembly toward the at least one folded carton in said carton supply position.

19. The carton feed and opening machine of claim 18, wherein each said at least one suction cup on each said support arm is constructed and arranged to move along said pick line into a fully extended position toward the at least one folded carton in said carton supply position to engage the at least one folded carton, and to move along said pick line into a fully retracted position between said feeder wheels to withdraw said at least one folded carton from said carton magazine and to place said at least one folded carton on the periphery of said spaced feeder wheels.

20. The carton feed and opening machine of claim 19, wherein each said at least one suction cup on each of said support arms is constructed and arranged to remain aligned with said pick line as said feeder wheels are being rotated in the direction of the path of travel and as each of said at least one suction cups is being reciprocably moved along said pick line into said fully extended position and said fully retracted position.

21. The carton feed and opening machine of claim 18, wherein each of said at least one suction cups on each of said support arms is constructed and arranged to be sequentially aligned with and move along said pick line to engage said at least one folded carton in said carton supply position and to withdraw said at least one folded carton from said carton magazine, and to sequentially place said at least one folded carton on the periphery of said spaced feeder wheels.

22. The carton feed and opening machine of claim 18, each of said at least one suction cups on each of said support arms being constructed and arranged to apply a suction force to the at least one folded carton held in said carton supply position to engage the at least one folded carton thereon, to withdraw said at least one unopened carton from said carton magazine, and to place said at least one folded carton on the periphery of said spaced feeder wheels.

23. The carton feed and opening machine of claim 22, further comprising a spaced series of nip rollers supported on said framework, said nip rollers being closely spaced from said vacuum conveyor belt for receiving said at least one folded carton between said nip rollers and said vacuum conveyor belt from the periphery of said feeder wheels as said feeder wheels are rotated in the direction of the path of travel, and to hold said at least one folded carton on said vacuum conveyor belt with said nip rollers.

24. The carton feed and opening machine of claim 23, wherein each of said at least one suction cups on said support arms is constructed and arranged to release said suction force applied to the at least one folded carton held on the periphery of said feeder wheels as said at least one folded carton is passed between said nip rollers and said vacuum conveyor belt.

25. The carton feed and opening machine of claim 14, further comprising drive means for moving said vacuum conveyor belt in the direction of the path of travel, said vacuum conveyor belt including a plurality of vacuum openings defined in the surface thereof in spaced series and extending along the length of the vacuum conveyor belt for holding the first side of the at least one folded carton along at least a portion of the length of the vacuum conveyor belt, and at least one vacuum chamber positioned on said framework and being generally sealed on at least a portion of the length of said vacuum conveyor belt to create a suction force along at least a portion of the length of the surface of said vacuum conveyor belt as said spaced series of vacuum openings pass over said at least one vacuum chamber for holding the first side of said at least one unopened carton on the vacuum conveyor belt.

26. The carton feed and opening machine of claim 25, further comprising a spaced series of nip rollers supported on said framework, said nip rollers being closely spaced from said vacuum conveyor belt and extending along a first portion of the length of said vacuum conveyor belt for receiving said at least one folded carton between said nip rollers and said vacuum conveyor belt from the periphery of said feeder wheels as said feeder wheels are rotated in the direction of the path of travel.

27. The carton feed and opening machine of claim 26, wherein said suction force is created only along a second portion of the length of said vacuum conveyor belt extending from said spaced series of nip rollers to hold the first side of said at least one folded carton on said second portion of the vacuum conveyor belt as the carton is moved in the direction of the path of travel.

28. The carton feed and opening machine of claim 27, wherein said carton opening wheel assembly is constructed and arranged to apply a second suction force to the second side of said at least one folded carton as the first side of the carton is held on said vacuum openings of said second portion of said vacuum conveyor belt as the carton is moved in the direction of the path of travel to open said at least one folded carton.

29. The carton feed and opening machine of claim 28, said carton opening wheel assembly comprising drive means for rotating the carton opening wheel assembly in the direction of the path of travel in timed relationship with the movement of said vacuum conveyor belt, and a plurality of suction devices spaced equally apart from one another, each of said suction devices being sized and shaped for engagement with the second side of said at least one folded carton as said at least one folded carton is moved along said vacuum conveyor belt for opening the carton.

30. The carton feed and opening machine of claim 29, said chain conveyor comprising a series of spaced pairs of lugs extending along the length of said chain conveyor, each of said spaced pairs of lugs including a lead lug and a trailing lug, wherein the third side of the carton is moved into engagement with said lead lug as the carton is moved by said vacuum conveyor belt against said lead lug to erect the carton on said chain conveyor, said trailing lug being constructed and arranged to move against the second side of the carton after the second side of the carton has been released by said carton opening wheel.

31. The carton feed and opening machine of claim 14, said spaced feeder wheels being constructed and arranged to vary the spacing therebetween for receiving folded cartons of differing widths thereon.

32. The carton feed and opening machine of claim 31, wherein a first feeder wheel is fixed in position on said main shaft, and a second feeder wheel is constructed and arranged to be selectively moved toward and away from the first feeder wheel on said main shaft.

33. The carton feed and opening machine of claim 32, wherein said second feeder wheel is constructed and arranged to be moved toward and away from said first feeder wheel by said means for rotating said carton selector wheel in the direction of the path of travel.

34. A method of feeding and opening a folded carton on a packaging machine, the packaging machine including an elongate framework having an infeed end and a spaced discharge end, a path of travel extending from the infeed end toward the discharge end of the framework, a carton magazine positioned at the infeed end of the framework, the carton magazine having a supply of folded cartons with at least one folded carton held in a carton supply position, said method comprising the steps of:

a) positioning a spaced pair of feeder wheels, said feeder wheels being formed about a main shaft supported on the framework, with respect to the carton magazine;

b) rotating said spaced pair of feeder wheels with a first drive means in the direction of the path of travel;

c) reciprocably moving one of a spaced series of suction devices supported on and between said feeder wheels along a fixed radial pick line emanating from said main shaft toward the at least one folded carton held in the carton supply position and engaging the at least one folded carton with at least one of said suction devices, applying a first suction force to the at least one folded carton, and withdrawing the at least one folded carton from the carton magazine in response thereto;

d) holding the at least one folded carton withdrawn from the carton magazine on the periphery of said feeder wheels with said first suction force; and e) passing the at least one folded carton between a spaced series of nip rollers and an endless vacuum conveyor belt positioned on the framework with respect to said feeder wheels, said nip rollers being positioned on the framework with respect to the vacuum conveyor belt, and releasing the at least one folded carton from said first suction force in response thereto.

35. The method of claim 34, further comprising the steps of:

a) holding a first side of the at least one folded carton on said vacuum conveyor belt with said nip rollers, and moving the at least one folded carton in the direction of the path of travel along at least a portion of the length of said vacuum conveyor belt with said nip rollers in response thereto;

b) applying a second suction force to said first side of the at least one folded carton with said vacuum conveyor belt and moving the at least one folded carton in the direction of the path of travel out from between said nip rollers and said vacuum conveyor belt on said vacuum conveyor belt in response thereto;

c) applying a third suction force to a second side of the at least one folded carton hingedly connected to said first side with one of a series of second suction devices supported on a carton opening wheel positioned on the framework with respect to said vacuum conveyor belt and being rotated in the direction of the path of travel, and opening the at least one folded carton in response thereto;

d) releasing said second side of said at least one carton from said one of said second suction devices and moving a third side of said at least one carton hingedly connected to said first side into engagement with a lead lug of a carton transport conveyor positioned on the framework with respect to said vacuum conveyor belt and being moved in the direction of the path of travel; and e) releasing the first side of said at least one carton from said vacuum conveyor belt in response thereto and moving a trailing lug spaced from said lead lug against the second side of said at least one carton to hold the carton on said carton transport conveyor.

36. The method of claim 35, wherein step a) of moving the at least one folded carton in the direction of the path of travel along at least a portion of the length of said vacuum conveyor with said nip rollers includes the step of moving the at least one folded carton at a first velocity, and step c) of rotating said carton opening wheel in the direction of the path of travel includes the step of varying the rotational velocity of said carton opening wheel with respect to said first velocity.

37. The method of claim 35, wherein steps a) and b) of moving the at least one folded carton in the direction of the path of travel along said vacuum conveyor with said nip rollers, and with said second suction force by said vacuum conveyor belt, respectively, include the step of moving the at least one folded carton at a first velocity, and wherein step d) of moving said carton transport conveyor includes the step of moving said carton transport conveyor at a second velocity less than said first velocity.

38. The method of claim 34, including the step of varying the spacing between said spaced pair of feeder wheels for feeding folded carton of varying sizes on said machine.

39. The method of claim 38, including the step of using said first drive means for varying the spacing between said feeder wheels.

* * * * *